US006270191B1

(12) United States Patent
Morikoshi et al.

(10) Patent No.: US 6,270,191 B1
(45) Date of Patent: Aug. 7, 2001

(54) INK JET RECORDING HEAD AND INK JET RECORDER

(75) Inventors: Koji Morikoshi; Tsuyoshi Kitahara, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/230,314

(22) PCT Filed: Jun. 3, 1998

(86) PCT No.: PCT/JP98/02448

§ 371 Date: Jan. 22, 1999

§ 102(e) Date: Jan. 22, 1999

(87) PCT Pub. No.: WO98/55317

PCT Pub. Date: Dec. 10, 1998

(30) Foreign Application Priority Data

Jun. 4, 1997 (JP) ..... 9-161853
Jun. 16, 1997 (JP) ..... 9-158778
Jun. 27, 1997 (JP) ..... 9-187591

(51) Int. Cl.[7] ..... B41J 2/165; B41J 2/135; B41J 2/14

(52) U.S. Cl. ..... 347/44; 347/22; 347/33; 347/44; 347/45; 347/47

(58) Field of Search ..... 347/44, 33, 45, 347/46, 22, 47, 68, 71, 36; 346/140.1

(56) References Cited

U.S. PATENT DOCUMENTS 4,479,135 * 10/1984 Kohashi ..... 346/140 R

FOREIGN PATENT DOCUMENTS

0383019 A2 * 8/1990 (EP) ..... 347/33
0 631 869 A1 1/1995 (EP) ..... B41J/2/135
01 195048 1/1988 (JP) ..... B41J/3/04
63-095951 4/1988 (JP) ..... B41J/3/04
401195048 * 8/1989 (JP) ..... 347/33
1-275047 11/1989 (JP) ..... B41J/3/04
4-169238 6/1992 (JP) ..... B41J/2/045
405084930 * 4/1993 (JP) ..... 347/33
5-338160 12/1993 (JP) ..... B41J/2/045
8-025630 1/1996 (JP) ..... B41J/2/045

OTHER PUBLICATIONS

International Search Report.

* cited by examiner

*Primary Examiner*—John Barlow
*Assistant Examiner*—An H. Do
(74) *Attorney, Agent, or Firm*—Sughrue, Mion, Zinn, Macpeak & Seas, PLLC

(57) ABSTRACT

An ink-jet recording head for an ink-jet recording apparatus, includes a plurality of pressure generating chambers, a nozzle plate in which a plurality of nozzle apertures which communicate with the pressure generating chambers are formed, and a protective layer formed in the vicinity of the nozzle apertures, wherein when a cleaning blade for cleaning the nozzle plate of leavings of at least ink, comes in contact with the nozzle apertures when the blade is pressed on the nozzle plate, the blade elastically contacts the protective layer and the nozzle plate without damaging an ink-repellent layer disposed around the nozzle apertures, as the blade is moved in a direction toward an open exhaust port disposed on a side of an end of the nozzle plate, such that the leavings are exhausted through the open exhaust port by movement of the blade.

32 Claims, 21 Drawing Sheets

INK JET RECORDING HEAD AND INK JET RECORDER

FIELD OF THE INVENTION

The present invention relates to an ink-jet recording head for jetting ink pressurized in a pressure generating chamber by pressurizing means from a nozzle aperture as an ink droplet, and in more detail, relates to an ink-jet recording head in which a nozzle aperture can be prevented from being clogged by a wiping member.

DESCRIPTION OF THE RELATED ART

An ink-jet recording head is provided with a nozzle plate wherein nozzle apertures are made at a predetermined pitch in a thin plate, a pressure generating chamber communicating with each nozzle aperture and a reservoir for supplying ink to a pressure generating chamber as is well-known, and is constituted so that an ink droplet is jetted from a nozzle aperture by pressurizing ink in a pressure generating chamber by a piezoelectric vibrator, a heater element and others.

As dust on recording paper and the leavings of ink adhere to a nozzle aperture and the vicinity and the nozzle aperture is often clogged because an ink-jet recording head executes printing at an interval to the extent that the ink-jet recording head almost comes in contact with recording paper and ink including a solid component such as dye is used, a nozzle plate is wiped by a blade of a rubber plate every predetermined time to remove dust on recording paper and the leavings of ink.

In the meantime, as described above, as an interval between a nozzle plate and recording paper is extremely small, the recording paper comes in contact with a nozzle aperture and an ink-repellent layer provided around the nozzle aperture may be worn.

Therefore, as shown in FIG. 21A, a measure to prevent recording paper from coming in contact with a protective layer in the vicinity of each nozzle aperture N by forming the protective layer composed of a metallic layer 1 to 30 $\mu$m thick in an area apart by approximately 100 to 150 $\mu$m from each nozzle aperture N of a nozzle plate P so that a concave portion C is formed around each nozzle aperture N is taken.

As the width of a concave portion C between adjacent nozzle apertures in the same column is extremely small to form an independent concave portion C every nozzle aperture as described above in recent cases, a pitch at which the nozzle apertures are arranged is 180 dpi per column and extremely small to thus enhance printing quality, it is very difficult to form such a concave portion. Therefore, as shown in FIG. 21B, a rectangular common concave portion C' is formed around nozzle apertures N in one column.

A recording head H provided with the nozzle plate P constituted as described above is relatively moved in the direction D or D' of a blade B (cleaning means) as shown as II and II' after the blade B is lifted on the side of the recording head H with the recording head located on the upstream side of the blade B arranged on a path of movement as shown in FIG. 22 (I). The blade B is elastically touched to the recording head H as shown as III and III' and hereby, cleaning is executed.

At this time, as the most area of the blade B is dropped in the-concave portion C', comes in contact with and rubs an ink-repellent layer F with strong pressure, there is a problem that the ink-repellent layer F is worn, scratched leavings K of ink are accumulated particularly along a wall W2 on the downstream side out of walls W1 and W2 partitioning the concave portion C' as shown in FIGS. 23A and 23B, and the recording paper is dirtied, a direction in which an ink droplet is jetted varies, or the like.

SUMMARY OF THE INVENTION

An ink-jet recording head according to the present invention comprises plural pressure generating chambers arranged at a predetermined pitch linearly in one or more columns for pressurizing ink by pressurizing means and a nozzle plate in which plural nozzle apertures each of which communicates with each pressure generating chamber are formed, and a protective layer for regulating so that a part of a blade comes in contact with a nozzle aperture when the blade is pressed on the nozzle plate is formed in the vicinity of the above nozzle aperture in a state in which an open exhaust port is secured on the side of the end of the protective layer in a direction in which the blade for cleaning is moved.

Therefore, a first object of the present invention is to provide an ink-jet recording head wherein ink which adheres to the nozzle plate, the leavings of ink and dust on paper can be securely exhausted in an area which has no effect upon jetting an ink droplet without wearing an ink-repellent layer and further, the ink-repellent layer can be prevented from being worn or broken by contact between the ink-repellent layer and recording paper.

A second object of the present invention is to provide an ink-jet recording apparatus provided with cleaning means suitable for the above recording head.

BRIEF DESCRIPTION OF THE DRAWINGS

FIG. 4A is a front view, FIG. 4B shows the section viewed along a line A—A;

FIG. 7A is a front view and FIG. 7B shows the sectional structure viewed along a line B—B;

FIG. 9A is a front view, FIG. 9B shows the sectional structure viewed along a line C—C;

FIG. 11A is a front view and FIG. 11B shows the sectional structure viewed along a line D—D;

FIG. 12A is a front view and FIG. 12B shows the sectional structure viewed along a line E—E;

FIG. 14A is a front view and FIG. 14B shows the sectional structure viewed along a line F—F.

FIG. 15A is a front view and FIG. 15B shows the sectional structure viewed along a line G—G;

FIG. 16A is a front view and FIG. 16B shows the sectional structure viewed along a line H—H;

DETAILED DESCRIPTION OF THE PREFERRED EMBODIMENTS

Figure 1:
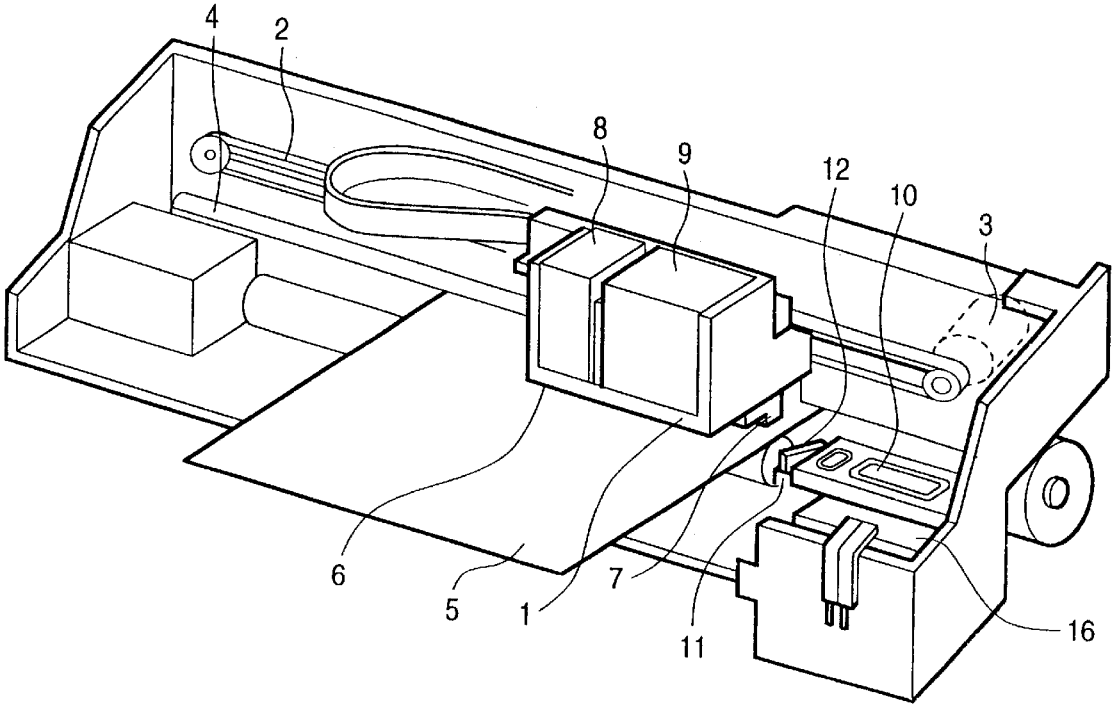
FIG. 1 is a perspective drawing showing an embodiment of a recording apparatus using an ink-jet recording head according to the present invention.

Embodiments showing the details of the present invention in the drawings will be described below.

FIG. 1 shows an embodiment of a recording apparatus using an ink-jet recording head according to the present invention, a carriage 1 is connected to a pulse motor 3 via a timing belt 2, the carriage is constituted so that it is guided by a guide member 4 and reciprocated in the direction of the width of recording paper 5 and ink-jet recording heads 6 and 7 described later are attached to the surface opposite to the recording paper 5, the lower surface in this embodiment. The ink-jet recording heads 6 and 7 are respectively supplied with ink by ink cartridges 8 and 9 mounted on the carriage 1, respectively jet an ink droplet on the recording paper 5 as the carriage 1 is moved, respectively form one or plural dots per one pixel and respectively print images and characters on the recording paper 5.

A capping device 10 is provided in a non-printing area, seals nozzle apertures of the recording heads 6 and 7 during rest to prevent the nozzle apertures from being dry and in the meantime, also functions as a receptacle for receiving an ink droplet jetted from the recording heads 6 and 7 by flushing operation executed during printing.

Figure 2A:
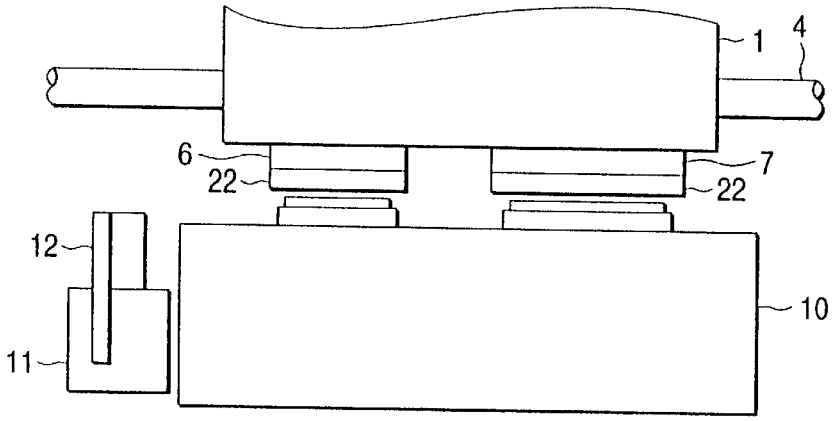
FIGS. 2A and 2B are a side view and a top view respectively showing the structure in the vicinity of a cleaning device.
Figure 2B:
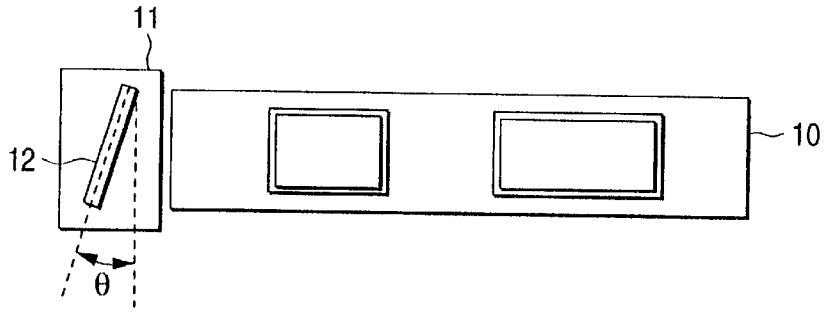

A cleaning device 11 is provided in the vicinity of the capping device in the non-printing. area and arranged so that a blade 12 for touching the nozzle plates of the recording heads 6 and 7 as shown in FIGS. 2 has a gradient of an angle θ with a direction perpendicular to a direction in which nozzle apertures are arranged, that is, a direction in which the carriage 1 is moved.

Figure 3:
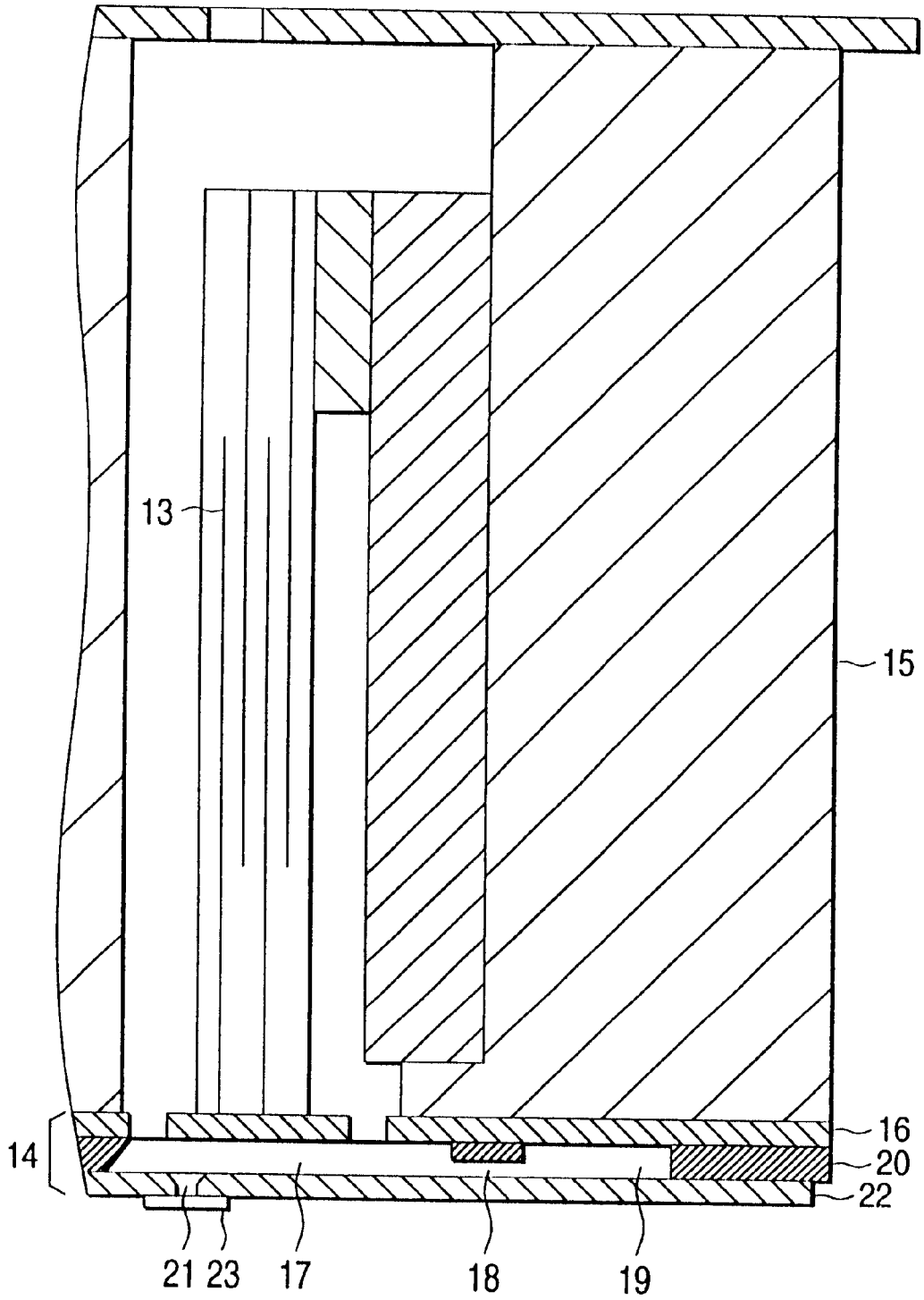
FIG. 3 is a section view showing an embodiment of the ink-jet recording head a riding to the present invention.

FIG. 3 shows an embodiment of the above recording head and pressure generating means, a piezoelectric vibrator 13 in this embodiment and a passage unit 14 to which displacement from the above piezoelectric vibrator is applied are fixed to a holder 15.

The passage unit 14 is constituted by laminating an elastic plate 16 which is in contact with the end of the piezoelectric vibrator 13 and to which elastic deformation is applied, a spacer 20 partitioning a pressure generating chamber 17, an ink supply port 18 and a reservoir 19, and a nozzle plate 22 provided with a nozzle aperture 21 communicating with the pressure generating chamber 17.

Figure 4A:
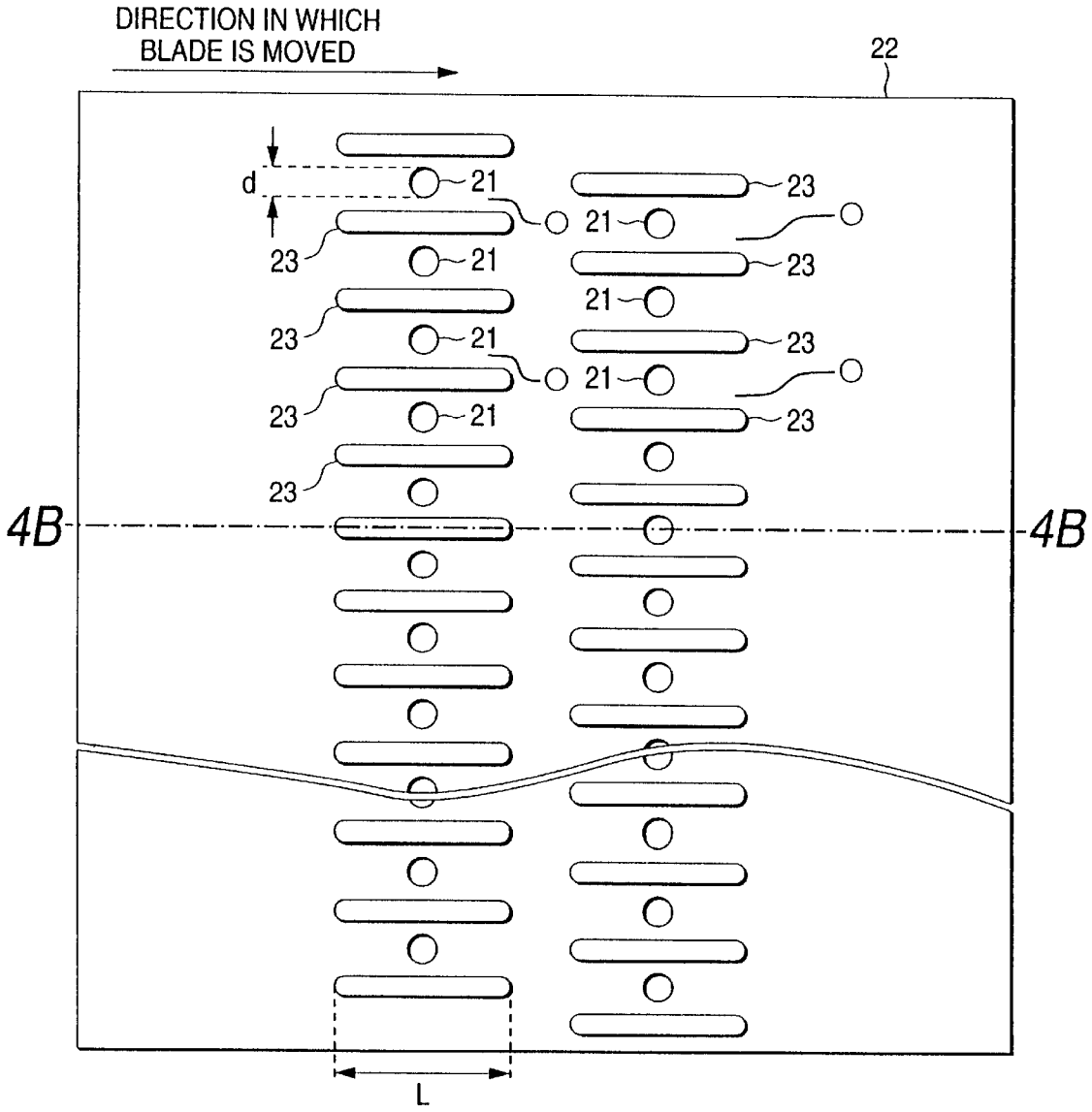
FIGS. 4A and 4B show an embodiment of a nozzle plate of the above recording head.
Figure 4B:
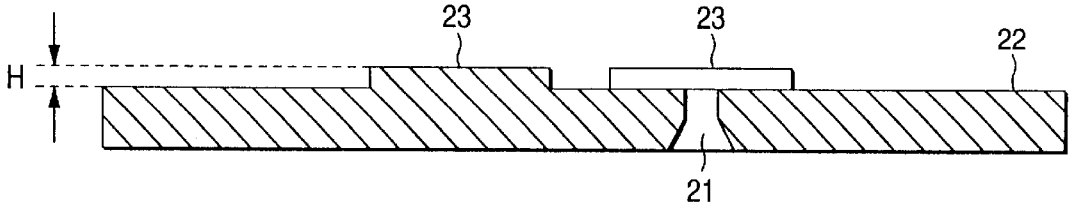

The nozzle plate 22 is provided with two columns of nozzle apertures 21 each of which is formed at predetermined pitch as shown in FIGS. 4, and long and narrow protective layers 23 extended in parallel with a wiping direction at the same pitch as a pitch between adjacent nozzle apertures 21 so that at least the protective layer opposite to the nozzle aperture 21 is discretely formed at each column of nozzle apertures 21. The height H of the protective layer 23 is set to approximately 2 to 10 μm and is formed so that the length L is at least larger than the diameter d of the nozzle aperture 21.

These protective layers 23 can be formed by etching a substrate to be the nozzle plate 22, electroforming metallic material on the nozzle plate 22 in a shape equivalent to the protective layer 23 or sticking a thin piece formed beforehand as another member.

Figure 5:
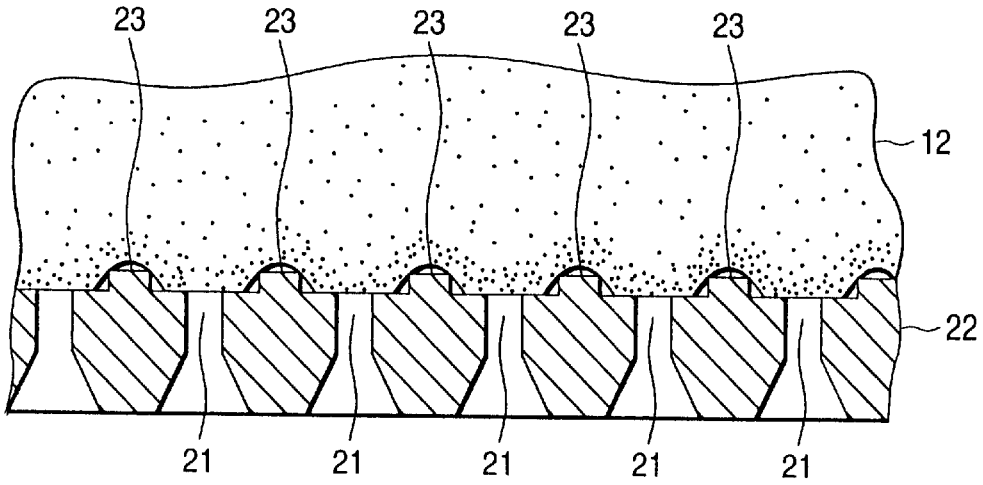
FIG. 5 shows a state in which a blade is in contact with the nozzle plate for cleaning.

In this embodiment, when the end of the blade 12 is touched to the nozzle plate 22 and wiping is executed if an ink droplet is not jetted from the nozzle aperture 21, the central area between the protective layers 23 elastically comes in contact with the face of the nozzle aperture 21 with weak strength suitable for removing the leavings of ink and dust on the paper because the surface of the blade 12 elastically comes in contact with the protective layer 23 as shown in FIG. 5.

In this state, when the blade 12 is relatively moved in a direction in which the protective layer 23 is extended, the leavings of ink and dust on the paper in the vicinity of the nozzle aperture 21 and further, ink which adheres to the blade 12, are swept into an area not related to jetting an ink droplet from a clear aperture O open at the other end of the protective layer 23 on the downstream side in a direction in which the blade 12 is moved without rubbing an ink-repellent layer formed around the nozzle aperture 21 with strong strength uselessly.

Figure 6:
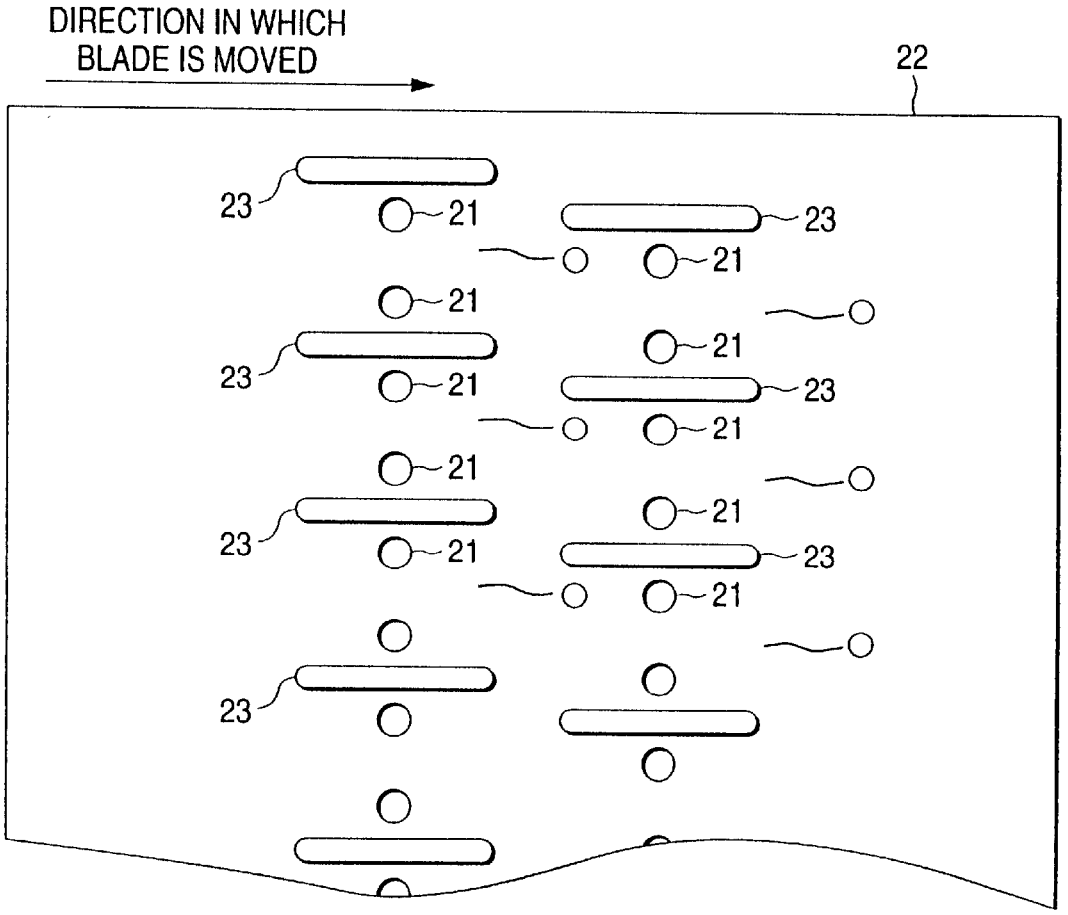
FIG. 6 is a front view showing the structure of a nozzle plate equivalent to another embodiment of the present invention.

In the above embodiment, the protective layer 23 is formed at the same pitch as a pitch between adjacent nozzle apertures, however, one protective layer 23 per plural nozzle apertures 21 may be also formed as shown in FIG. 6.

Figure 7A:
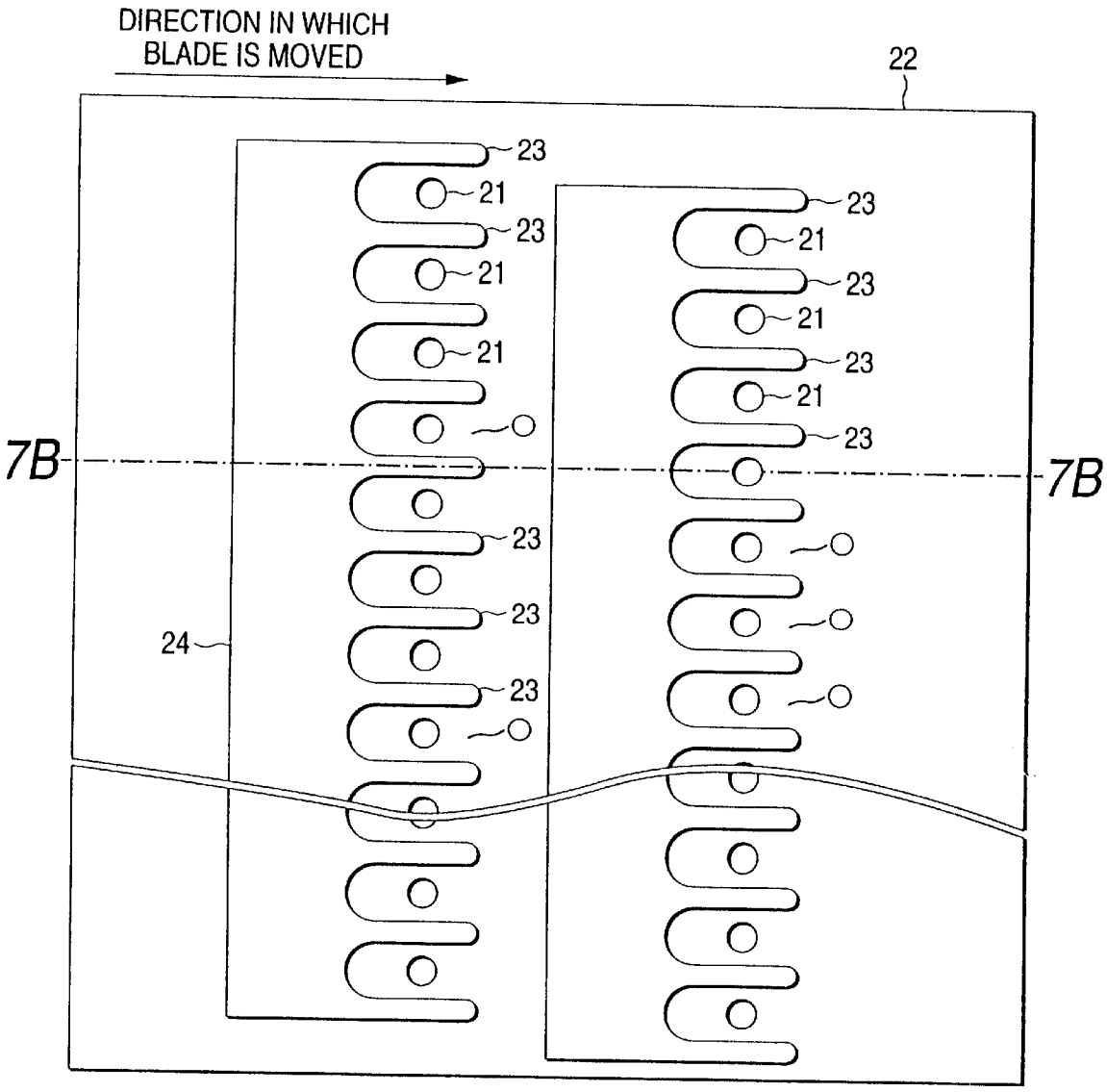
FIGS. 7A and 7B show the structure of a nozzle plate equivalent to further another embodiment of the present invention.
Figure 7B:
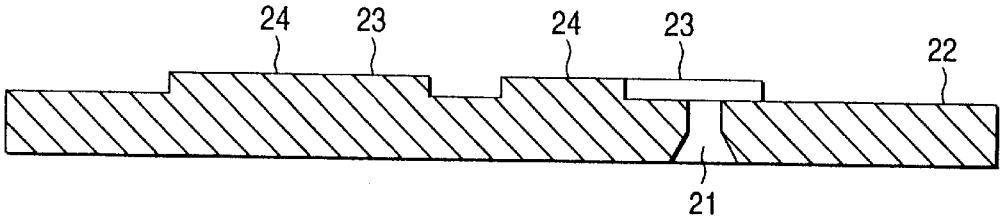

FIGS. 7A and 7B respectively show a second embodiment of the present invention and in this embodiment, a band 24 is formed by connecting the side of the admission port of a blade 12 of each protective layer 23 so that the downstream side of each protective layer 23 in a direction in which the blade 12 is moved is open.

According to this embodiment, as recording paper can be lifted up to the height of the protective layer 23 owing to the band 24 even if the end of the recording paper is in contact with the nozzle plates 10 of the recording heads 6 and 7 due to a jam of recording paper and others, an accident that strong strength is uselessly applied to the protective layer 23 by the end of the recording paper and the protective layer is lost can be prevented beforehand.

Figure 8:
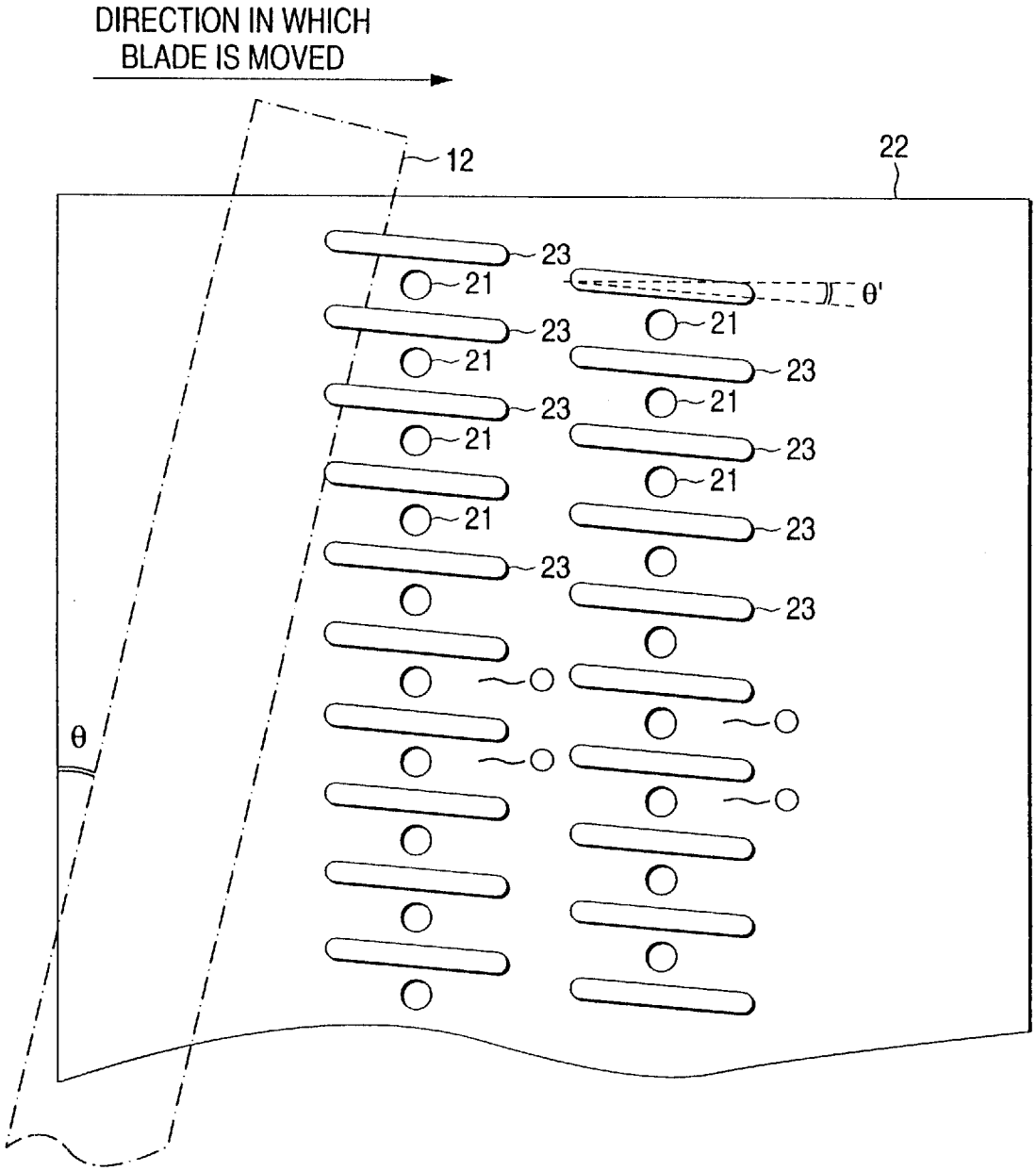
FIG. 8 is a front view showing the structure of a nozzle plate equivalent to furthermore another embodiment of the present invention.

In the above embodiment, a direction perpendicular to a direction in which nozzle apertures 21 are arranged is a horizontal direction. However, as shown in FIG. 8, if the protective layer 23 is tilted by the approximately similar angle θ' in case the blade 12 is tilted by an angle θ with a direction in which the nozzle apertures are arranged, the leavings of ink, dust on paper and ink can be efficiently exhausted into an area not related to jetting an ink droplet without reducing the rejection ratio.

Figure 9A:
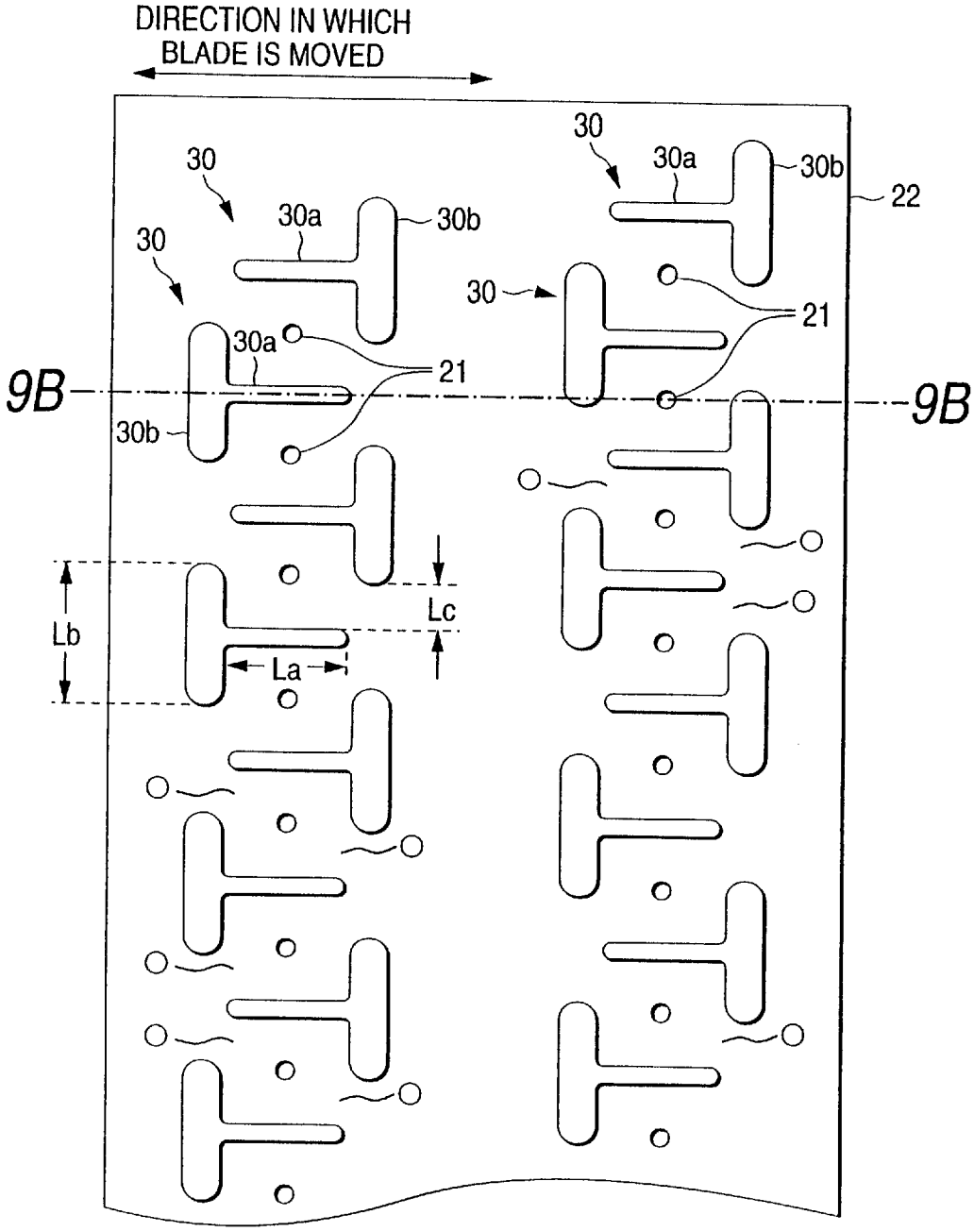
FIGS. 9A and 9B show the structure of a nozzle plate equivalent to furthermore another embodiment of the present invention.
Figure 9B:
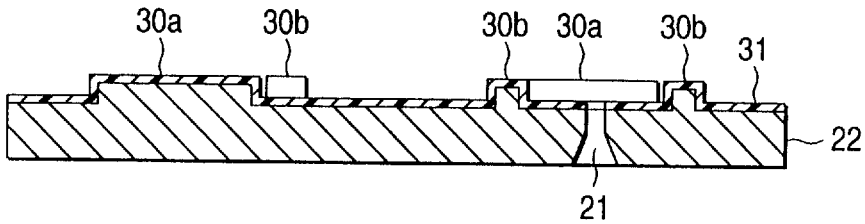

FIGS. 9 show the structure of a nozzle plate equivalent to further another embodiment of the present invention, a protective layer 30 is formed between nozzle apertures 21 formed at predetermined pitch in a nozzle plate 22.

The protective layer 30 comprises the body 30*a* parallel to a direction in which recording heads 6 and 7 are moved and a wider branch 30*b* than the width of the body which is perpendicular to the direction in which the recording heads 6 and 7 are moved and in the center of which the end of the body 30*a* is located.

The height H of the protective layer 30 is set to approximately 2 to 10 $\mu$m, and the body 30*a* and the branch 30*b* are formed so that each length La and Lb is at least larger than the diameter of the nozzle aperture 21.

These protective layers 30 are arranged at a predetermined pitch, at the same pitch as the nozzle aperture 21 in this embodiment so that an interval Lc is made between the end of the body 30*a* and the branch 30*b* of adjacent protective layers 30 to open at least a direction in which a blade 12 is moved.

These protective layers 30 can be readily formed by etching a substrate to be the nozzle plate 22 in a desired shape, forming them on the nozzle plate 22 by electroforming metallic material such as nickel in a shape equivalent to the protective layer 30 or forming a thin piece in a shape equivalent to the protective layer as another member and bonding the thin piece to the nozzle plate 22 as in the case of the above protective layer 23.

A reference number 31 denotes an ink-repellent layer and the ink-repellent layer is formed by coating or electrolytic plating ink-repellent material a few hundred nm to a few pm thick formed around the nozzle aperture 21 such as fluoropolymers.

Figure 10:
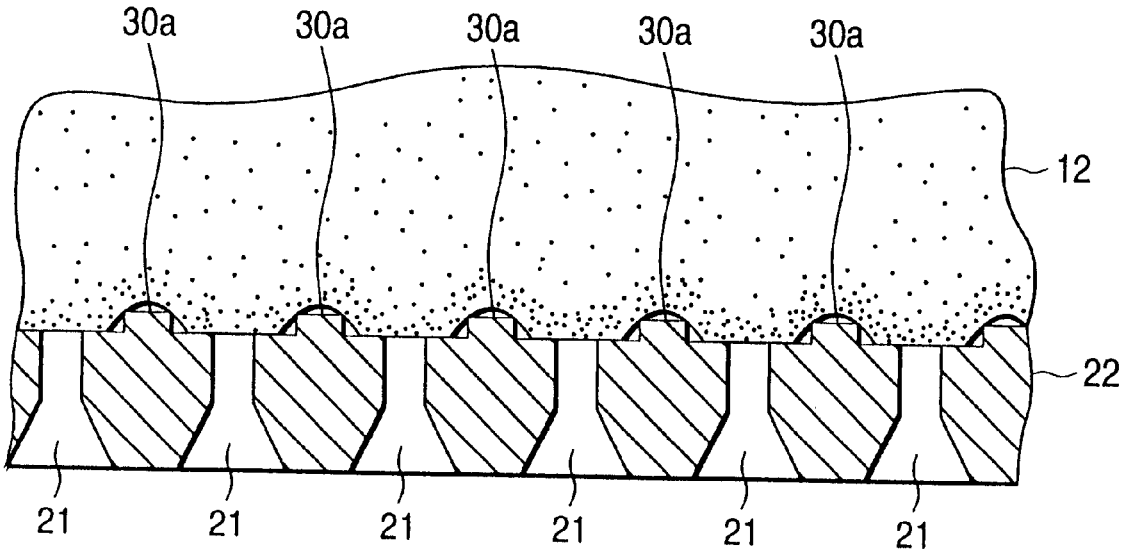
FIG. 10 shows a state in which a blade is in contact with the nozzle plate for cleaning.

In this embodiment, when the end of the wiper blade 12 is touched to the nozzle plate 22 and wiping is executed, the end of the blade 12 elastically comes in contact with a part between the bodies 30*a* of the protective layers 30 as shown in FIG. 10 when the blade passes the nozzle aperture 21. When the wiper blade 12 is relatively moved in the axial direction of the body 30*a* in this state, the leavings of ink and dust on the paper in the vicinity of the nozzle aperture 21 are removed, preventing the ink-repellent layer 31 from being worn or deteriorated because the ink-repellent layer 31 formed around the nozzle aperture 21 is never rubbed with strong contact force.

Ink and dust on the paper at the nozzle aperture 21 and in the vicinity which are wiped by the wiper blade 12 as described above, are swept in an area not related to jetting an ink droplet from an exhaust port located on the downstream side of the adjacent protective layers 30 and never remain around the nozzle aperture 21.

Further, as the blade 12 comes in contact with the branch 30*b* of the protective layer 30 formed in the following vicinity when the recording heads 6 and 7 and the blade 12 are relatively moved and reach the vicinity of the next column of nozzle apertures, ink and dust on the paper which respectively adhere immediately before are rubbed by the branch 30*b* formed in an area not related to jetting an ink droplet and the blade 12 is refreshed.

Therefore, even if plural columns of nozzle apertures are continuously wiped by the blade 12, ink, the leavings of ink and dust on the paper at the nozzle aperture 21 immediately before, can be possibly prevented from adhering to the nozzle aperture 21 in the next column and the vicinity.

Ink and dust on the paper which are rubbed by the branch 30*b* of the protective layer 30 and adhere to another branch 30*b* are flushed when the recording heads 6 and 7 are sealed by a capping device 10 and ink is forcedly exhausted from the recording heads 6 and 7 by a suction pump.

According to this embodiment, as the body 30*a* and the branch 30*b* approximately surround the nozzle aperture 21, recording paper can be securely prevented from coming in contact with the ink-repellent layer 31 in the vicinity of the nozzle aperture 21 due to a paper jam, or the like.

Figure 11A:
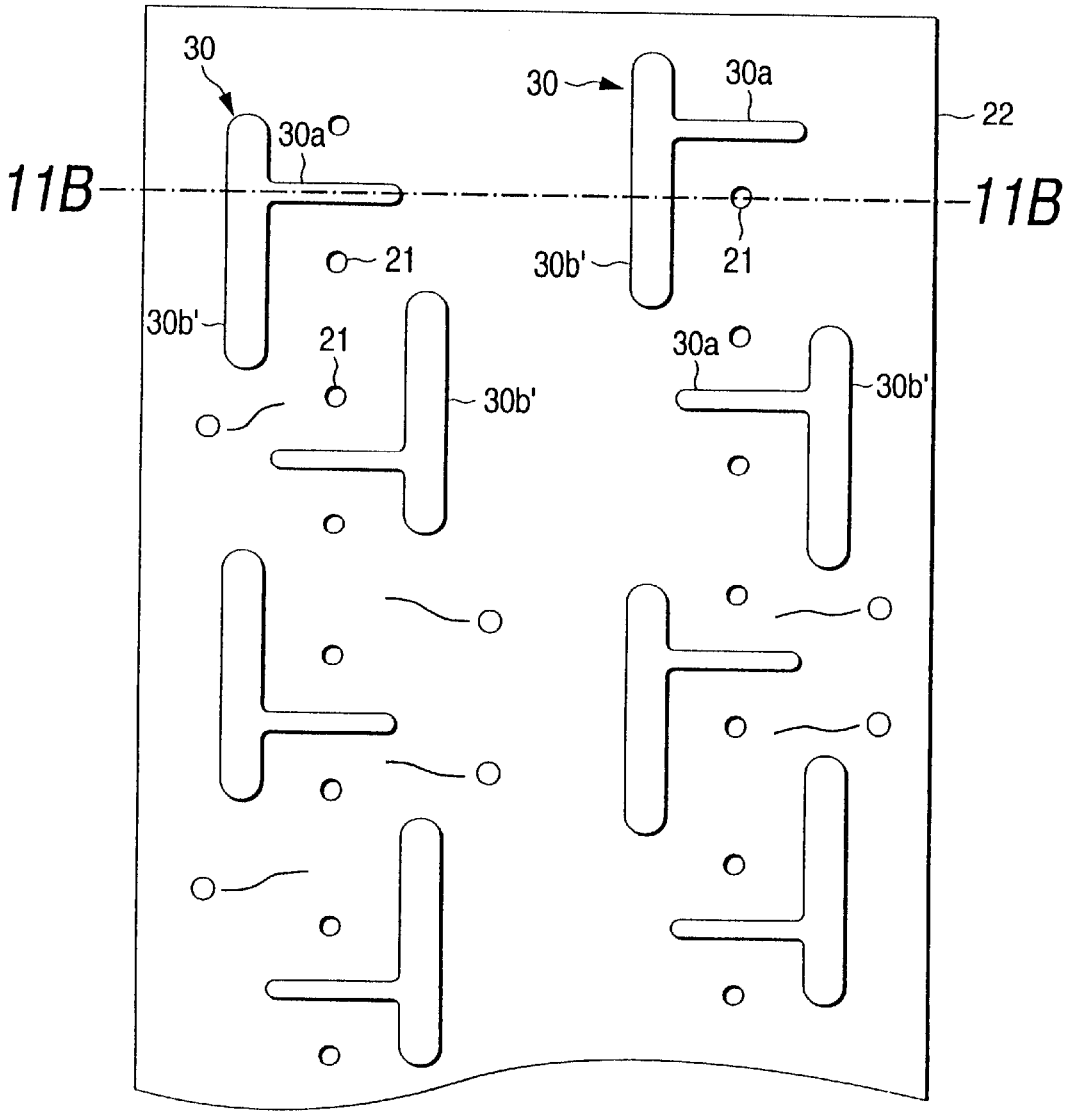
FIGS. 11A and 11B show the structure of a nozzle plate equivalent to furthermore another embodiment of the present invention.
Figure 11B:
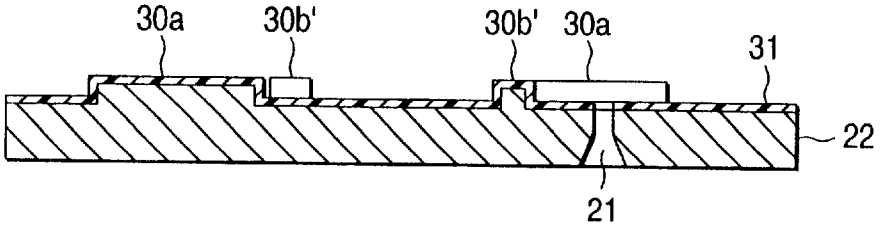

FIGS. 11 show furthermore another embodiment of the present invention and in this embodiment, the branch 30*b*' of a protective layer 30 is extended so that it is twice or more as long as a pitch between adjacent nozzle apertures 21 and the bodies 30*a* are arranged at an interval twice or more as long as a pitch between adjacent nozzle apertures 21.

According to this embodiment, the refresh rate of the wiper blade 12 is enhanced by a quantity in which the length of the branch 30*b* is longer than that in the above embodiment shown in FIGS. 9.

Figure 12A:
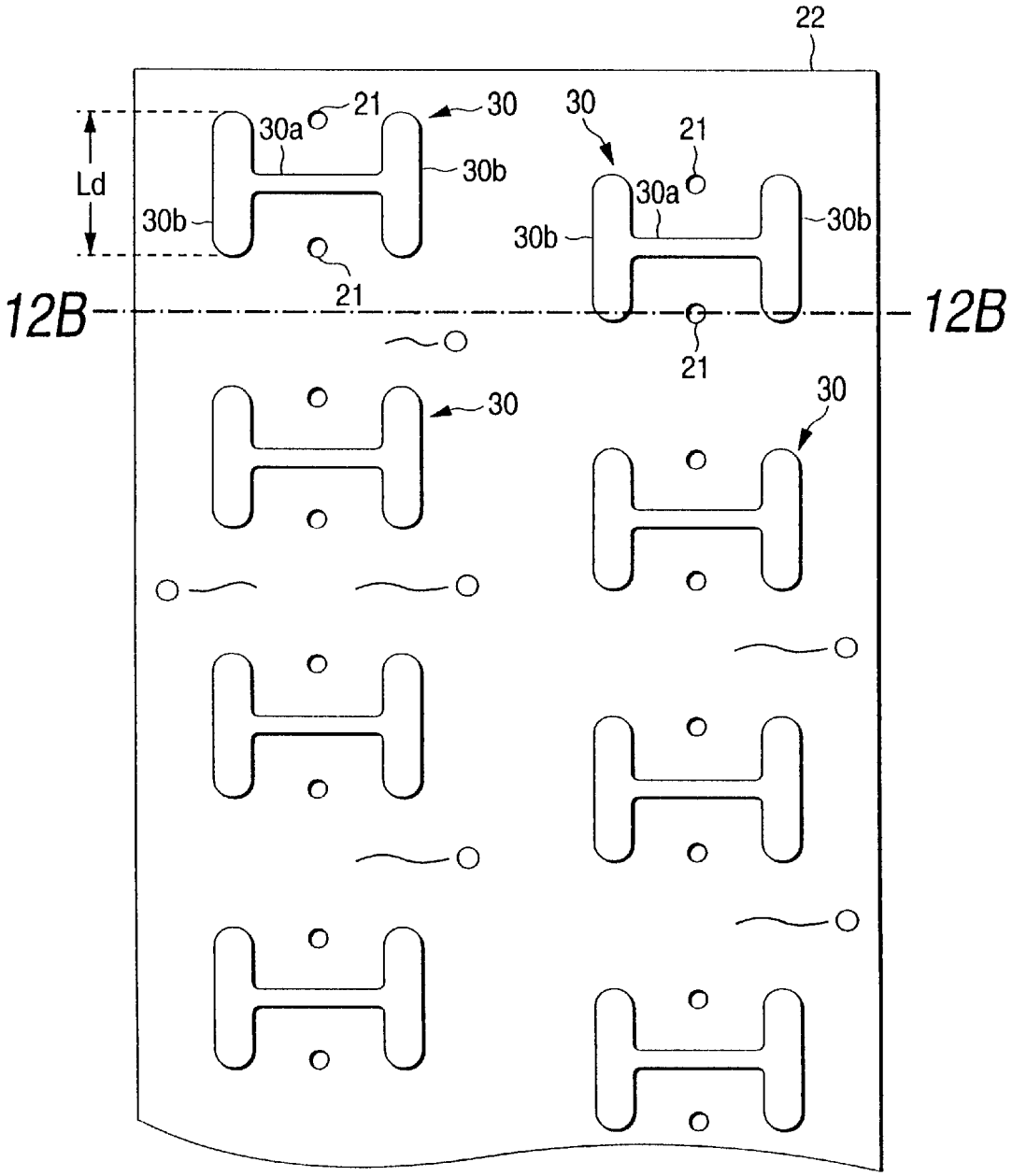
FIGS. 12A and 12B show the structure of a nozzle plate equivalent to furthermore another embodiment of the present invention.
Figure 12B:
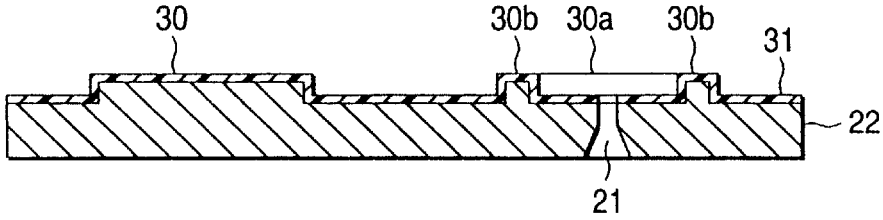

FIGS. 12 show furthermore another embodiment of the present invention, a protective layer 30 is constituted so that branches 30*b* longer than pitch between adjacent nozzle apertures 21 are formed at both ends of the body 30*a* with the body located in the center of the protective layer 30 and the protective layers are arranged at a pitch twice as long as the pitch between adjacent nozzle apertures 21 in each column so that they are zigzag.

Figure 13A:
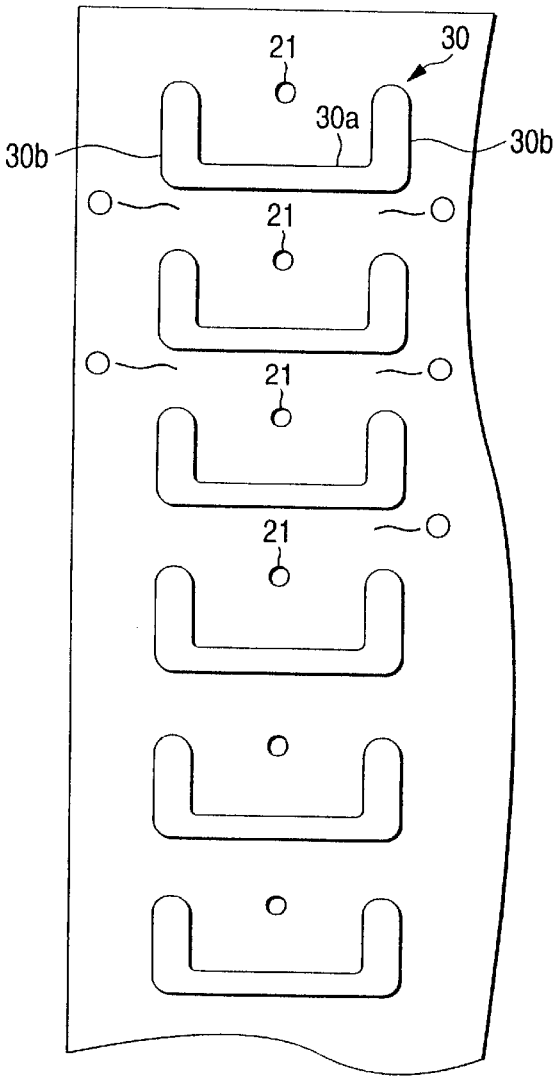
FIGS. 13A and 13B are respectively front views showing the structure of nozzle plates equivalent to furthermore another embodiment of present invention.
Figure 13B:
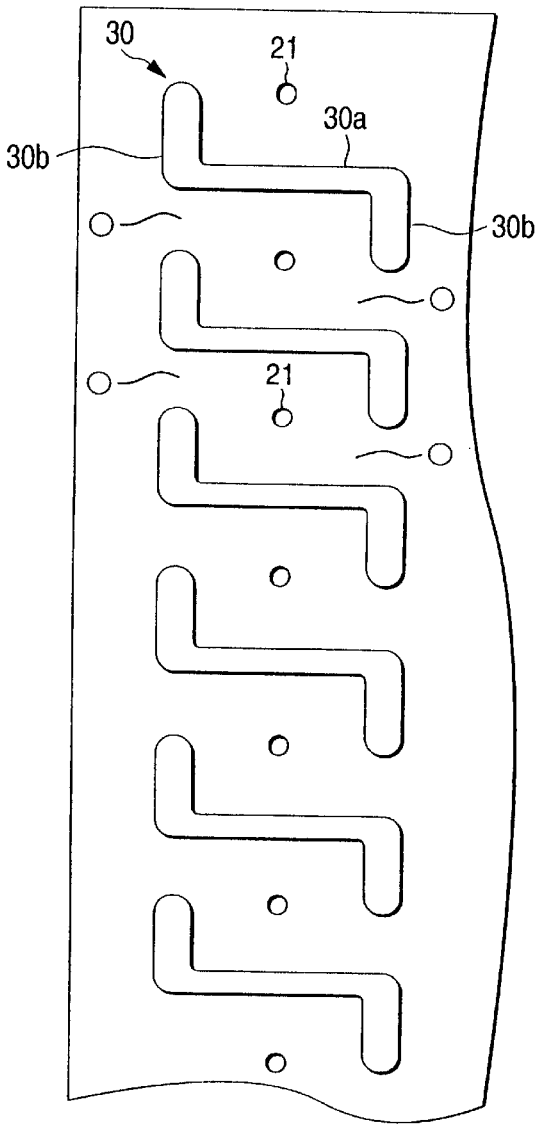

In the above embodiment, the body and the branch are arranged so that they are in the shape of a letter H, however, the similar action is produced even if as shown in FIG. 13A, the body 30*a* is arranged so that it is located between nozzle apertures and branches 30*b* are arranged on the same side, on the upper side in FIG. 13A in this embodiment so that an interval can be formed between the bodies 30*a* of adjacent protective layers 30 and as shown in FIG. 13B, the branches 30*b* are formed in reverse directions in the shape of a key.

Figure 14A:
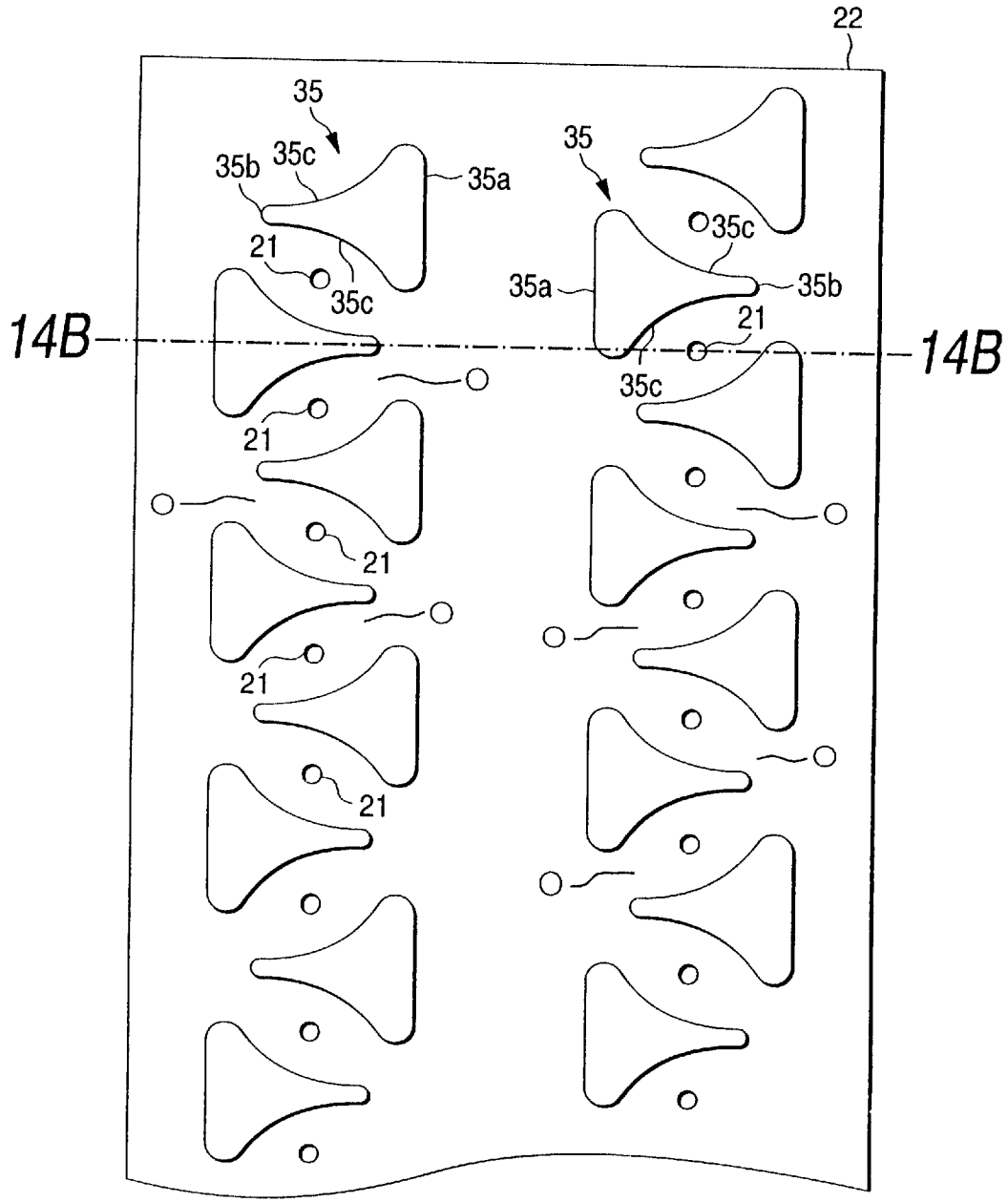
FIGS. 14A and 14B show the structure of a nozzle plate equivalent to furthermore another embodiment of the present invention.
Figure 14B:
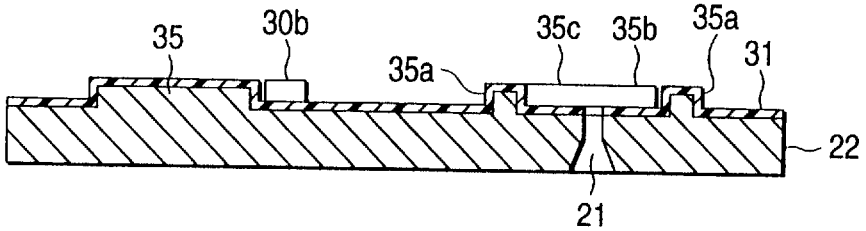

FIGS. 14 show furthermore another embodiment of the present invention and a protective layer 35 is formed approximately in the shape of a triangle symmetrical in a direction in which a linear part 35*a* which is approximately perpendicular to a path on which the blade is moved on the side opposite to a direction in which the blade 12 is moved and which is longer than pitch between adjacent nozzle apertures 21 and a curved part 35*b* forming a vertex 35*c* tapered from the linear part to the side of the nozzle aperture on the side opposite to the nozzle aperture 21 are perpendicular to a direction in which nozzle apertures are arranged.

The pitch between the adjacent protective layers 35 is equal to the pitch between the adjacent nozzle apertures 21 and the protective layers are arranged with them alternately inverted so that the side of the vertex is located on the side of the nozzle aperture.

Figure 15A:
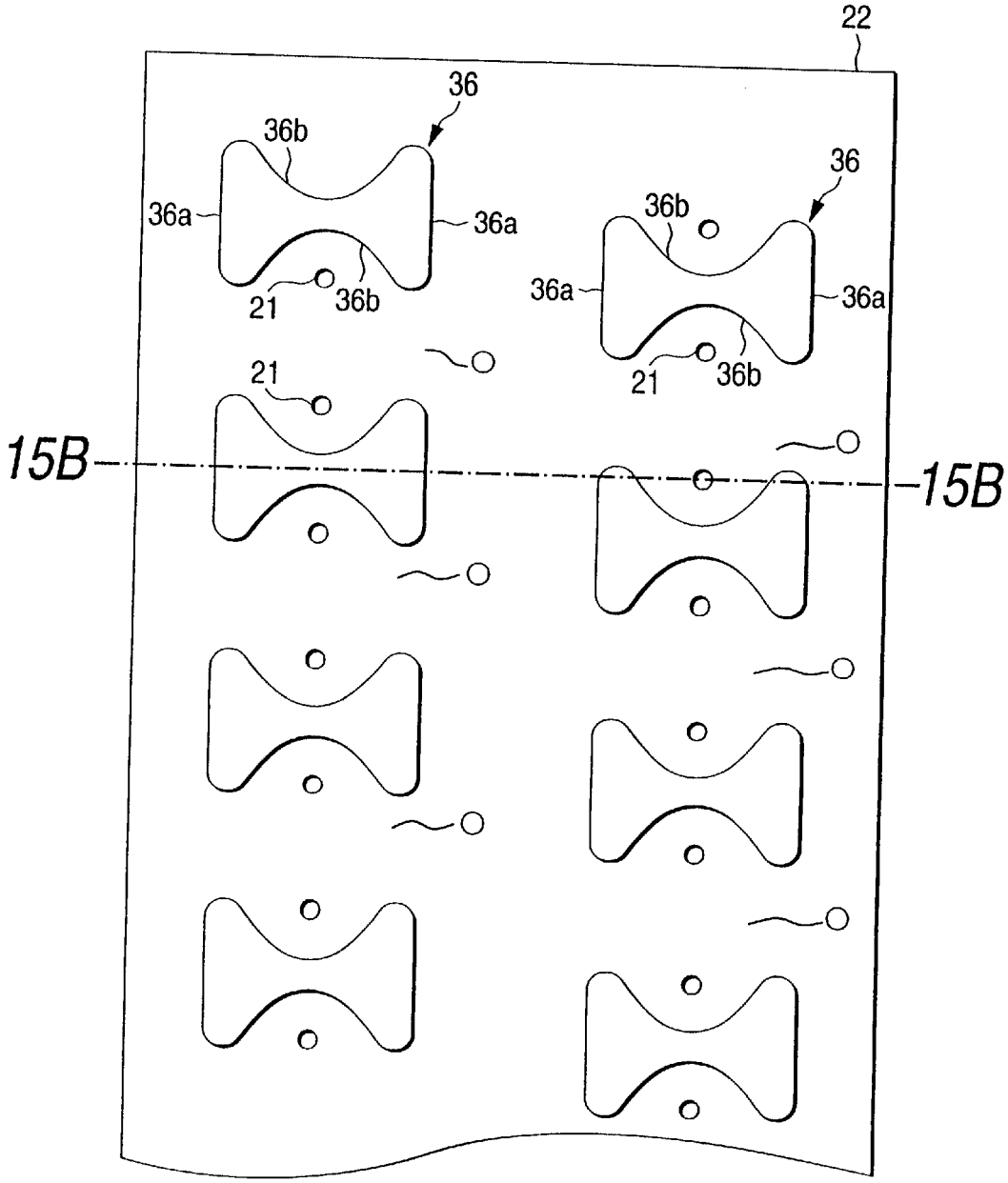
FIGS. 15A and 15B show the structure of a nozzle plate equivalent to furthermore another embodiment of the present invention.
Figure 15B:
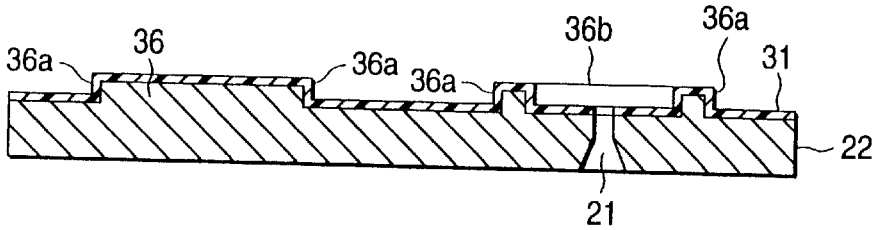

FIGS. 15 show furthermore another embodiment of the present invention and a protective layer 36 is formed so that a linear part 36*a* which is approximately perpendicular to a path on which a blade is moved on the side opposite to a direction in which the blade 12 is moved and which is longer than a pitch between adjacent nozzle apertures 21 and a curved part 36*b* the center of which is the narrowest part are both symmetrical in a direction in which the nozzle apertures are arranged and a direction perpendicular to the direction.

These protective layers 36 are arranged at a pitch twice as long as a pitch between adjacent nozzle apertures 21 so that the narrowest part is opposite to the nozzle aperture.

In this embodiment, as the blade is also elastically touched to the nozzle aperture with elastic pressure regulated by an interval in a concave portion after the blade is cleaned and refreshed by the linear part, so that ink, the leavings of ink, dust on paper and others in the vicinity of the nozzle aperture can be removed, preventing an ink-repellent layer from being possibly worn.

Figure 16A:
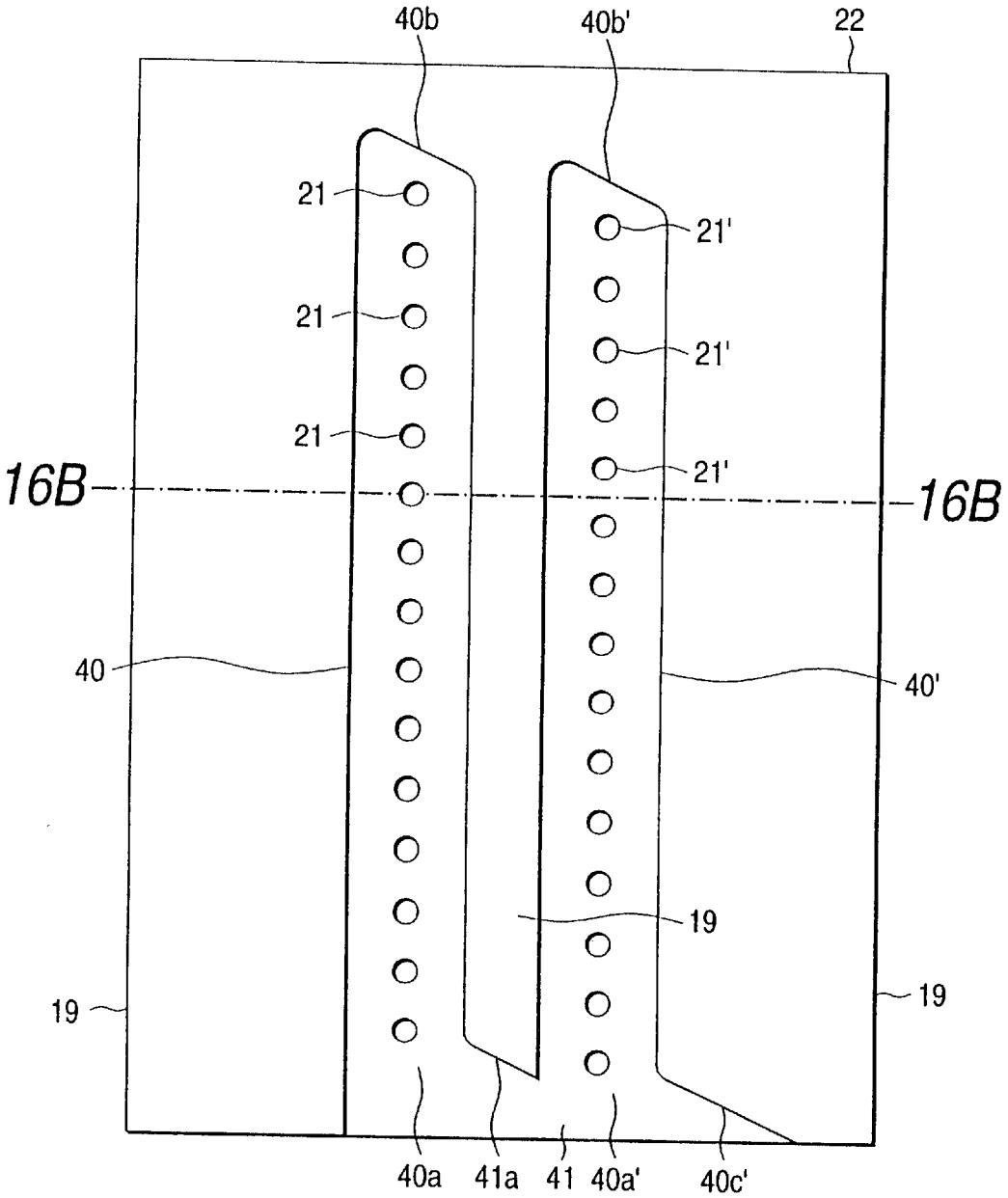
FIGS. 16A and 16B show the structure of a nozzle plate equivalent to the other embodiment of the present invention.
Figure 16B:
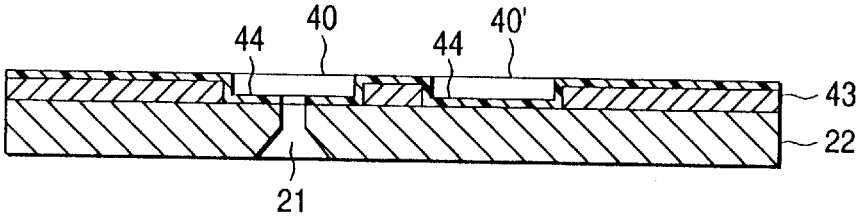

FIGS. 16 show the structure of a nozzle plate equivalent to furthermore another embodiment of the present invention and rectangular concave portions 40 and 40' respectively surrounding nozzle apertures 21 and nozzle apertures 21' in the respective columns and provided with open parts 40*a* and 40*a'* at the end of a nozzle plate 22 (the lower end in FIG. 16A) are formed. These concave portions 40 and 40' are connected by a concave portion 41 formed in a boundary between them.

These concave portions 40 and 40' and the concave portion 41 are constituted by providing a protective layer 43 made of metal and others with the thickness of approximately 5 to 30 μm by sputtering, electroless plating, electrolytic plating and others and an ink-repellent layer 44 is formed by material provided with ink repellency inside at least the concave portions 40 and 40'.

Walls 40*b* and 40*b'* on the respective sides (on the sides of the upper end in FIG. 16) on which the concave portions 40 and 40' are closed, a wall 41*a* regulating the concave portion 41 and a wall 40*c'* on the downstream side are formed as a slanted face on the downstream side in a direction in which a blade 12 is moved which is disconnected.

In this embodiment, as recording paper is supported by the surface of the protective layer 43 in case the recording paper comes in contact with the surface of the nozzle plate 22 in printing, the recording paper crosses the concave portions 40 and 40', does not come in contact with the ink-repellent layer 44 which has a great effect upon ink jetting performance in the concave portions 40 and 40' and therefore, does not peel the ink-repellent layer.

Figure 17A:
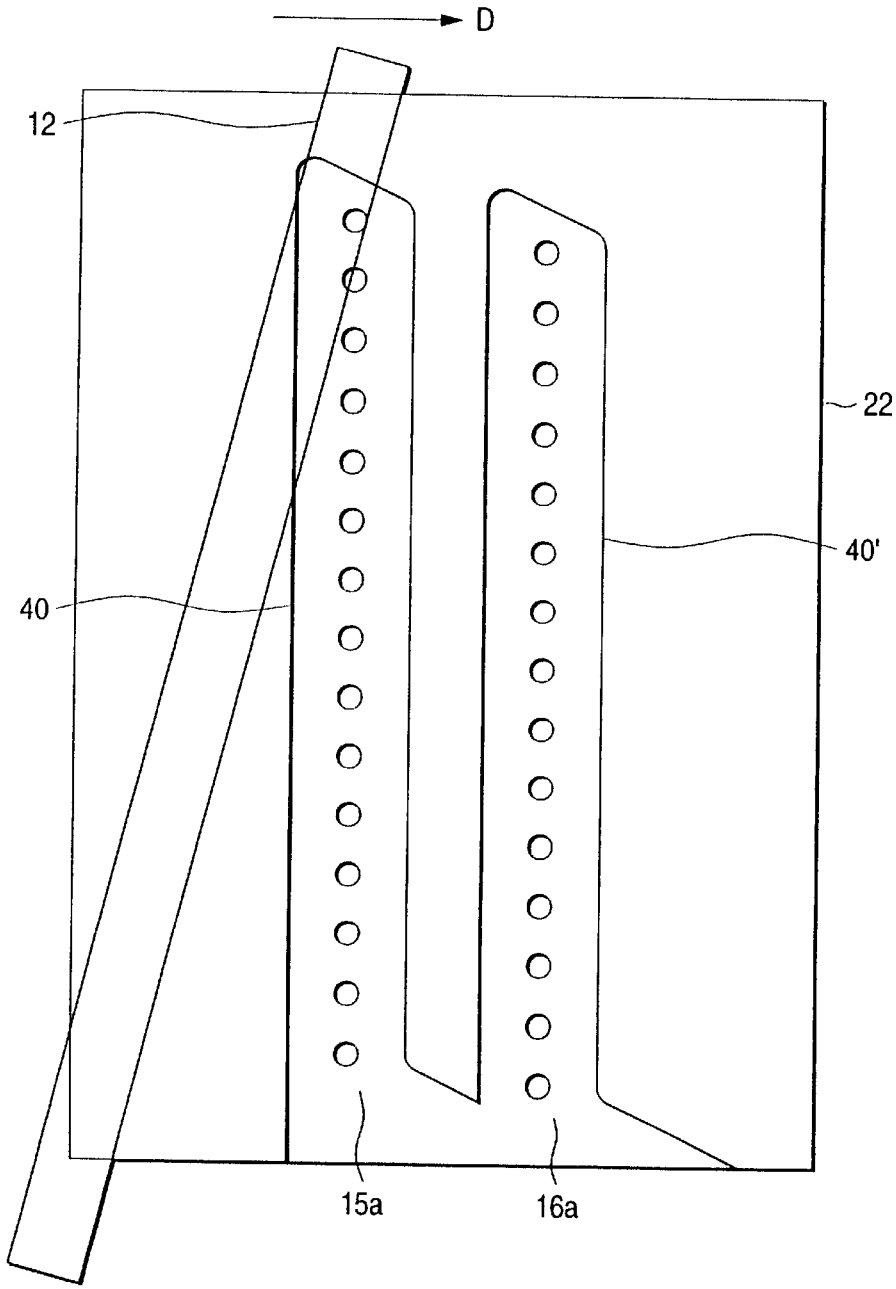
FIGS. 17A, 17B, 18A, 18B, 19A, 19B, 20A, and 20B respectively show a cleaning state of the nozzle plate shown FIGS. 16.
Figure 17B:
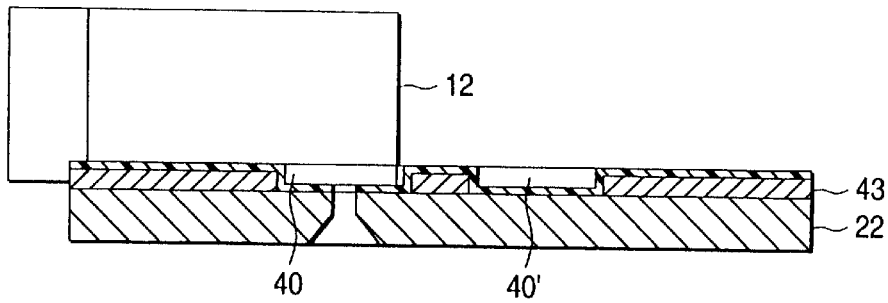

As the blade 12 has an angle θ with a direction in which nozzle apertures 21 are arranged when the blade 12 is elastically touched to the nozzle plates 22 of recording heads 6 and 7 and the blade 12 or the recording head 6 is relatively moved in a direction shown by an arrow D in FIG. 17A, if cleaning is required because of long-time printing, the most of the blade 12 is supported by the surface of the protective layer 43, only a part enters the concave portions 40 and 40' and is elastically touched to the ink-repellent layer 44 with light force as shown in FIG. 17B.

Figure 18A:
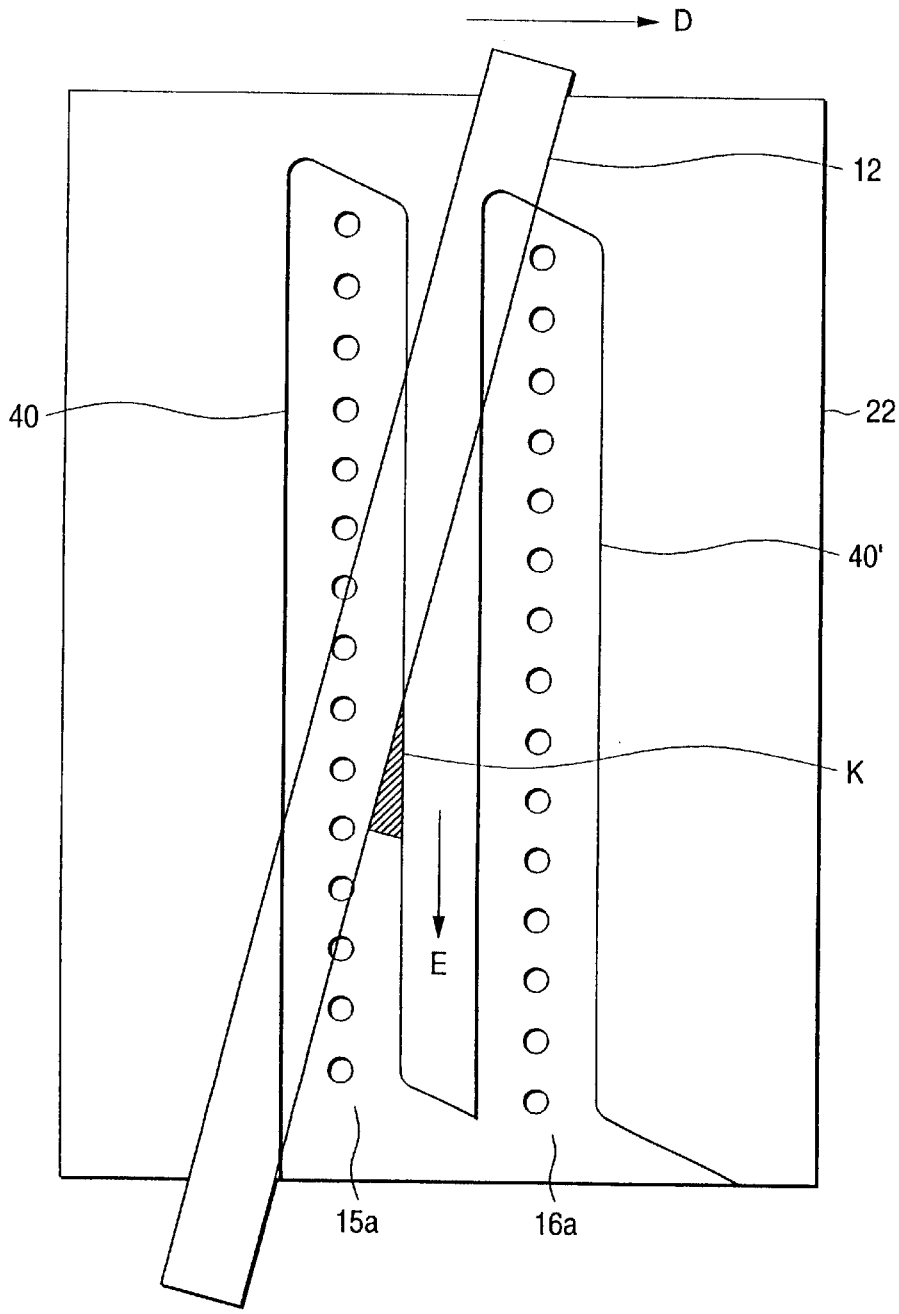
Figure 18B:
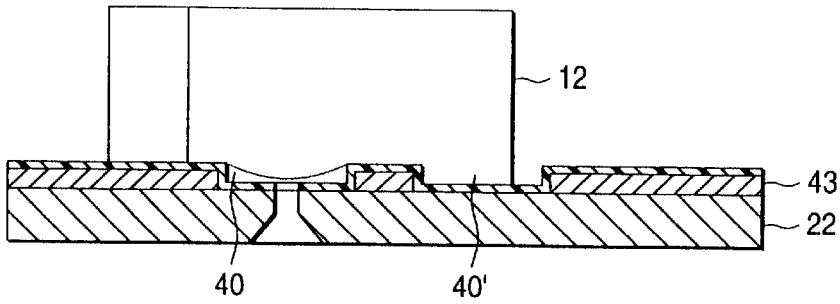

When the recording head 6 is further relatively moved to the blade 12, the leavings K of ink are gathered on a wall on the downstream side of the concave portion 40 and as the blade 12 is moved, the leavings of ink are moved in a direction shown by an arrow E in FIG. 18A, that is, on the side of the open port 40*a* as shown in FIG. 18A.

Figure 19A:
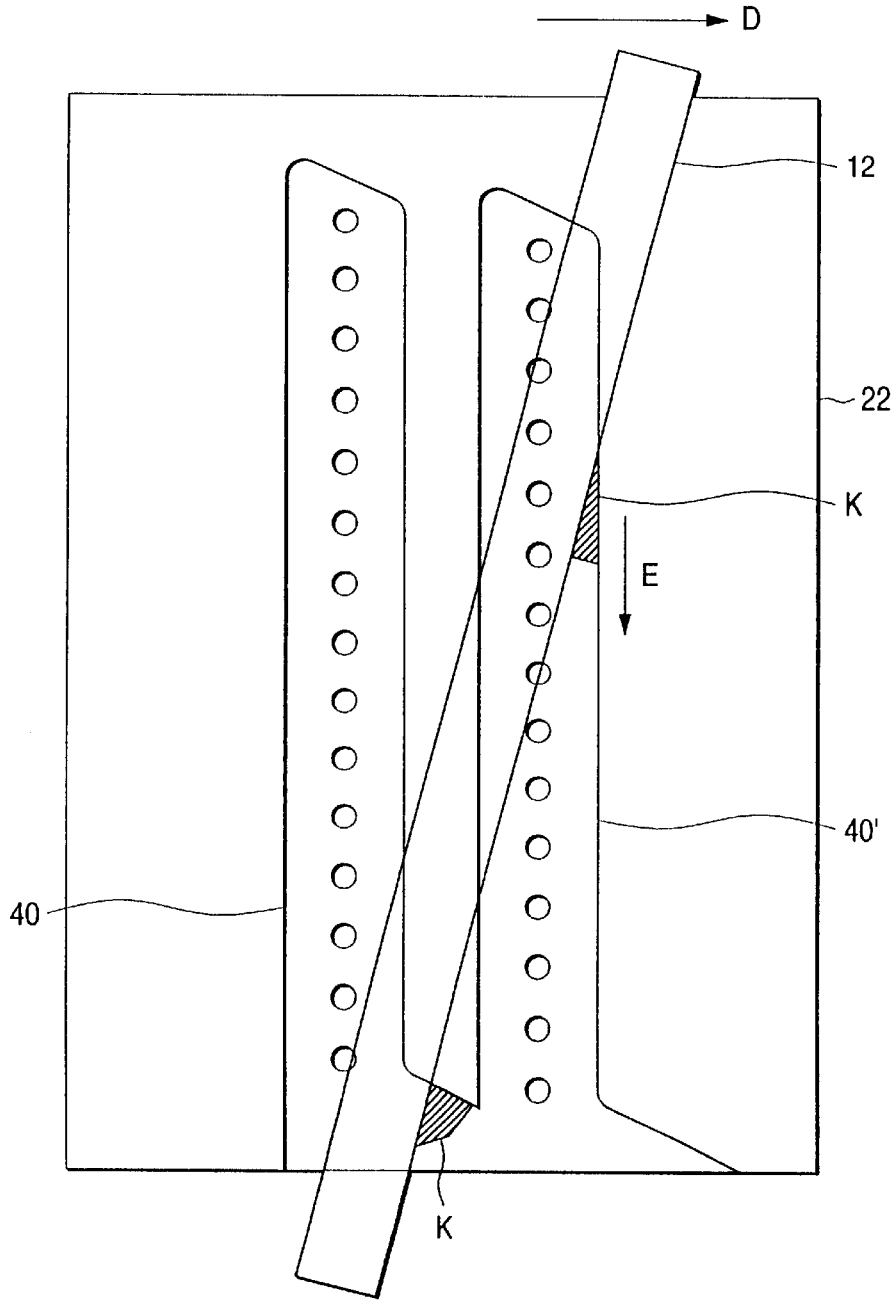
Figure 19B:
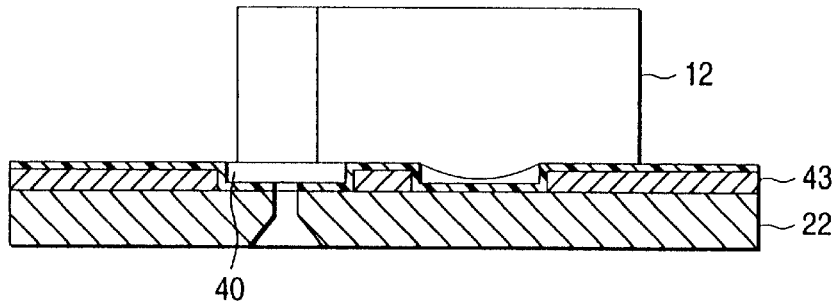
Figure 20A:
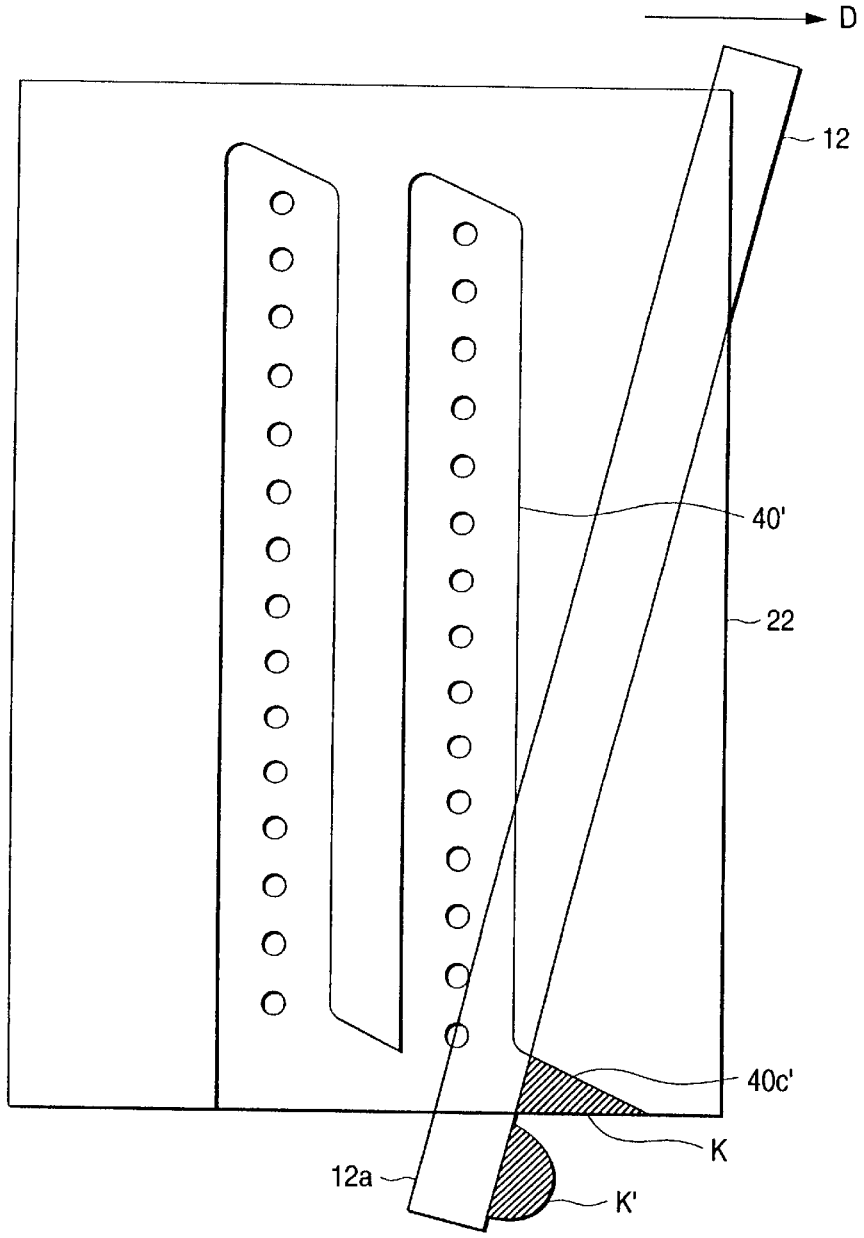
Figure 20B:
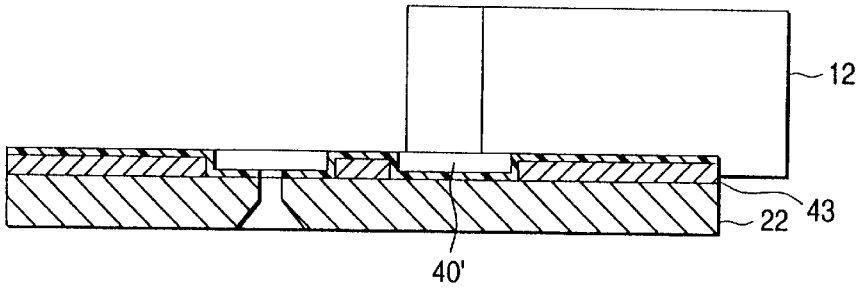
Figure 21A:
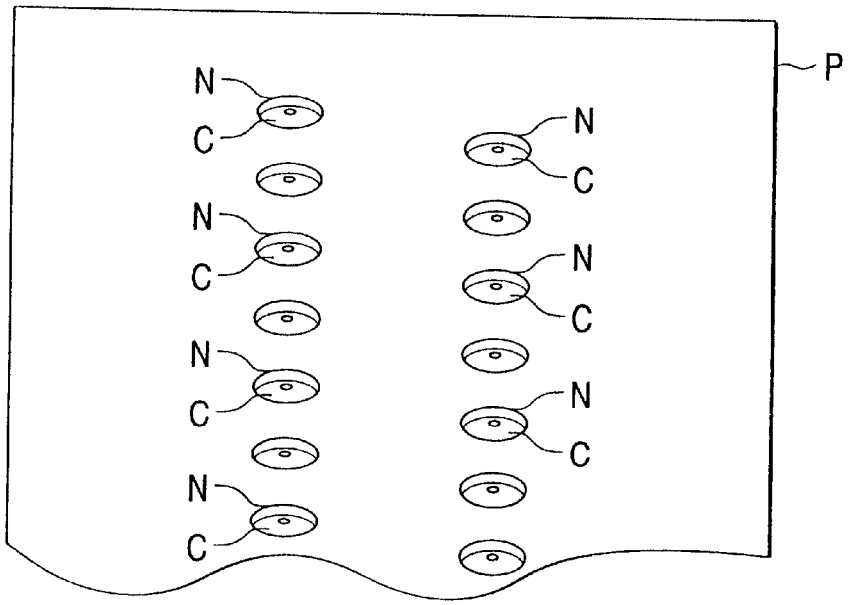
FIGS. 21A and 21B respectively show conventional type examples of nozzle plates of an ink-jet recording head used for a recording apparatus.
Figure 21B:
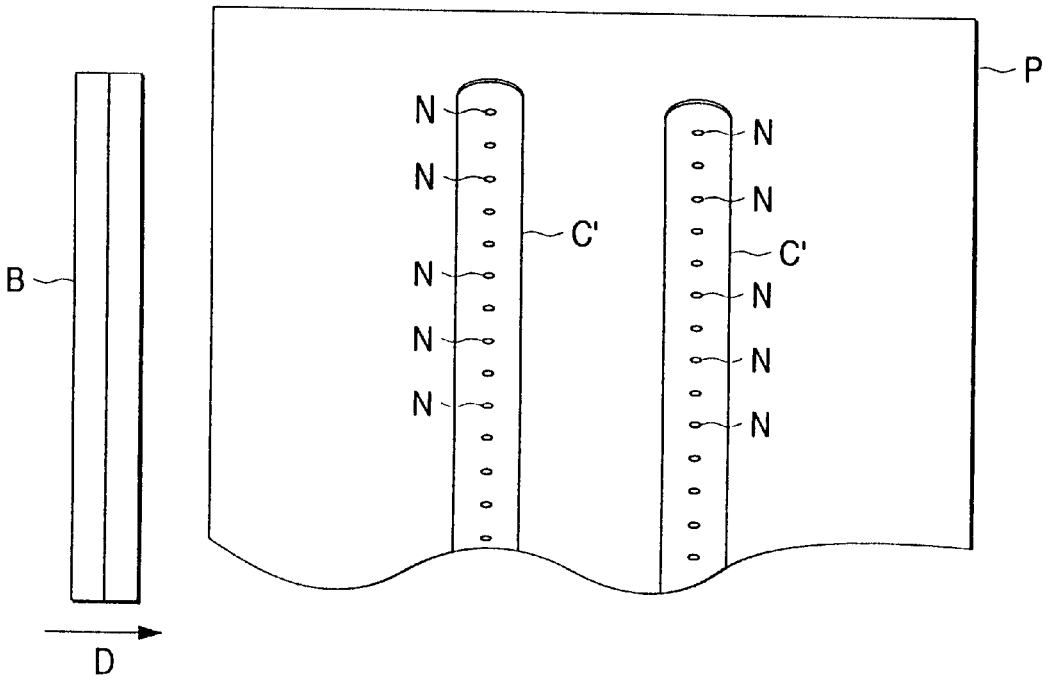
Figure 22:
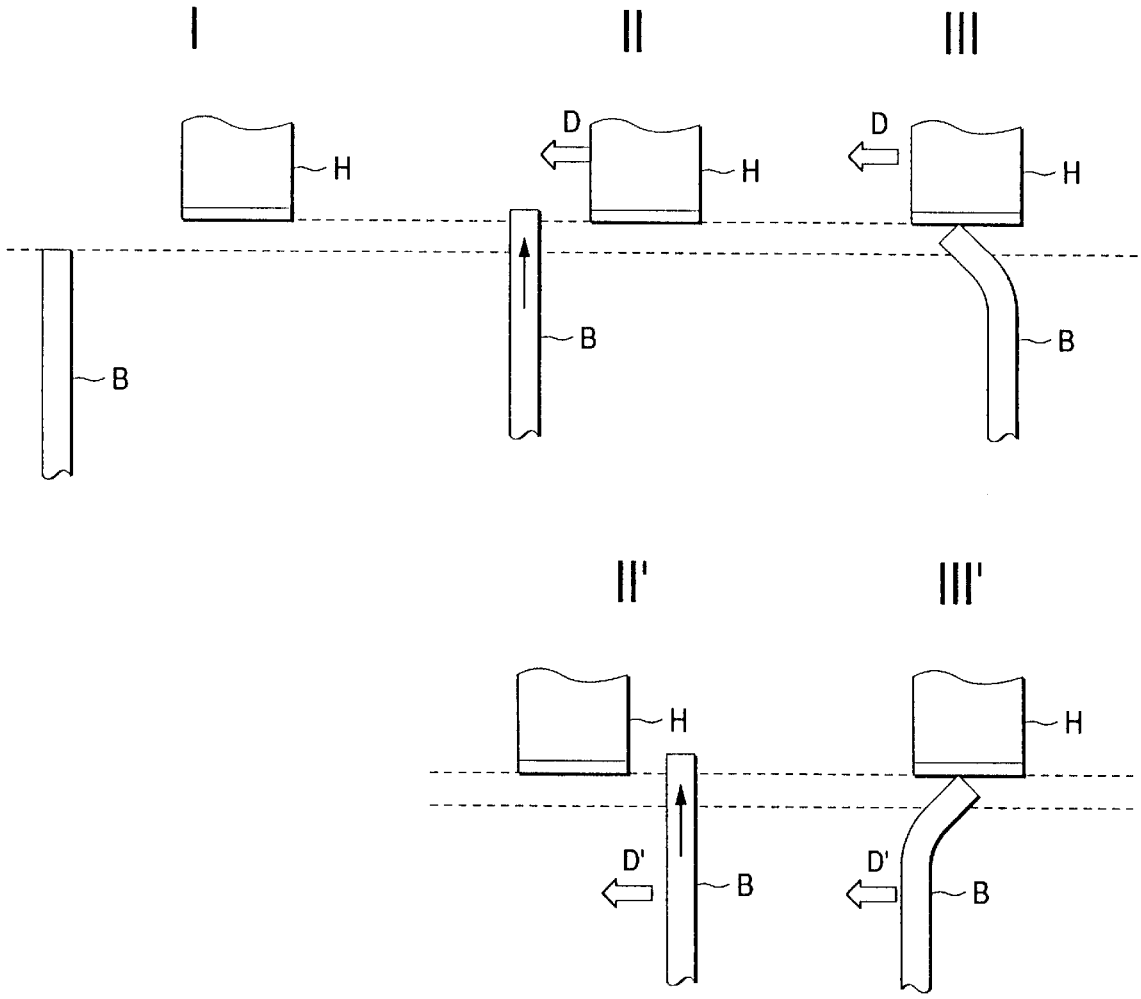
FIGS. 22 (I) to (III') are explanatory drawings for explaining wiping operation by blade and further.
Figure 23A:
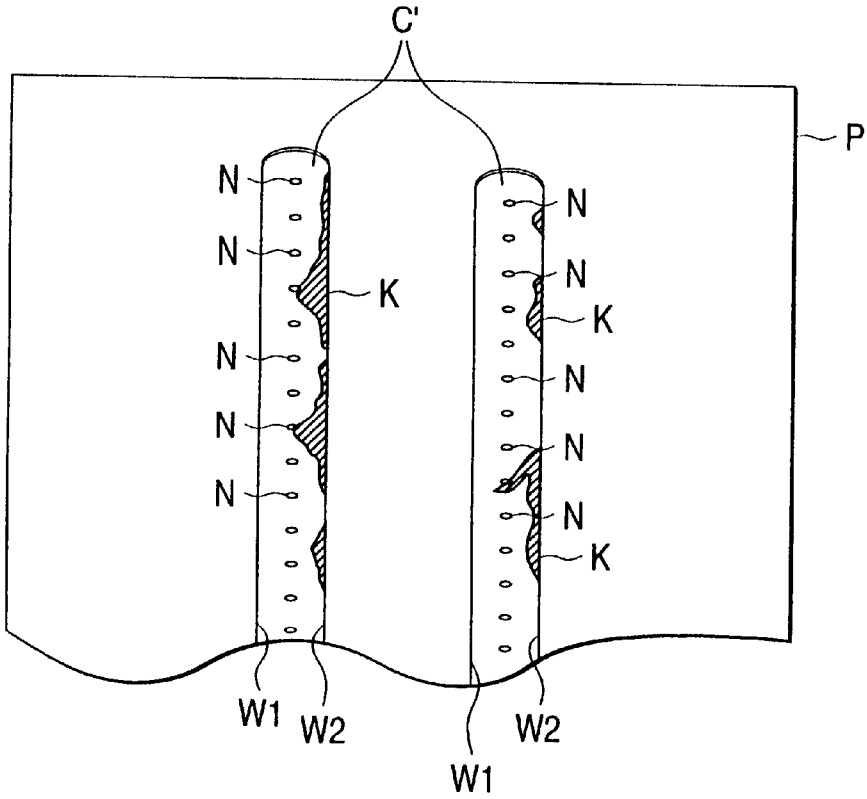
FIGS. 23A and 23B are a front view and a sectional view respectively showing a state of cleaning.
Figure 23B:
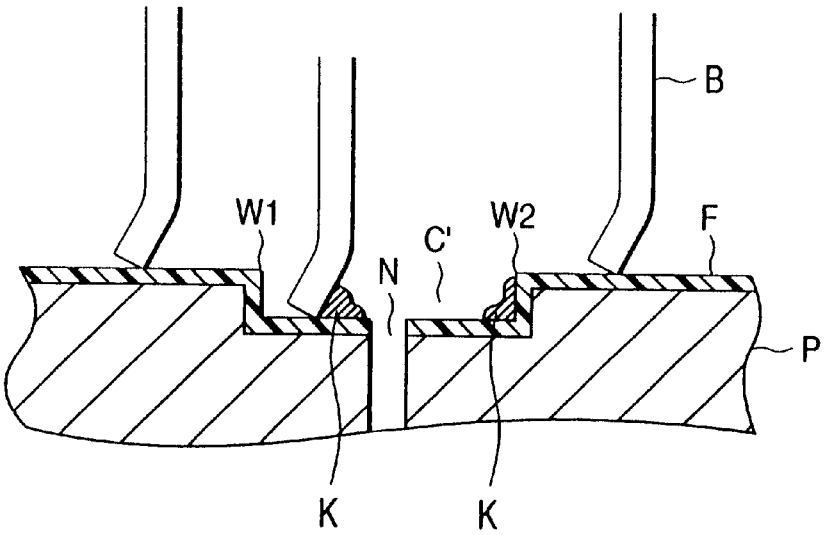

The leavings of ink are exhausted out of the nozzle plate 22 via the open port 40*a*. In the other concave portion 40', the leavings K of ink are also gathered on a wall on the downstream side, are moved to the open port 40*a'* of the concave portion 40' as described above as shown in FIG. 19, are guided to outside along the slope of the wall 40*c'* regulating the end of the concave portion 40' and are exhausted as shown in FIG. 20.

If the blade 12 is formed so that at least the open ports 40*a* and 40*a'* in an area in which the blade and the nozzle plate 22 are in contact are located outside the end of the nozzle apertures 21 (on the side of the lower end in FIG. 20), the leavings K' of ink can be guided in an area not related to jetting an ink droplet, further, if the blade is extended up to the end of the nozzle plate 22, the leavings of ink can be exhausted in an area with which the blade 12 is not in contact and the leavings of ink can be prevented from adhering to the blade 12 again in cleaning.

In the above embodiments, the ink-jet recording head of a type that a pressure generating chamber is pressurized by a piezoelectric vibrator is described as an example, however, it is clear that the similar action can be produced even if the present invention is applied to a nozzle plate of a bubble-jet recording head wherein a heater element is sealed in a pressure generating chamber and ink is jetted by thermal energy.

As described above, according to the present invention, if recording paper comes in contact with the nozzle plate, it can be prevented from coming in contact with the ink-repellent layer in an area in the vicinity of a nozzle aperture owing to the protective layer. In cleaning, the ink-repellent layer is prevented from being worn by regulating an area with which the blade comes in contact by the protective layer and elastically touching the blade with a light force enough to clean the face of an nozzle aperture. Further, ink, the leavings of ink and dust on paper respectively gathered by the blade can be exhausted in an area not related to jetting an ink droplet via the open port.

What is claimed is:

1. An ink-jet recording head, comprising:

a plurality of pressure generating chambers arranged at a predetermined pitch in at least one column for pressurizing ink by pressurizing means; and a nozzle plate in which a plurality of nozzle apertures, each of which communicates with a respective one of the pressure generating chambers, are formed, and a plurality of protective layers formed in predetermined shapes disposed according to a predetermined pattern, around said nozzle apertures, so that a part of a blade for cleaning the nozzle apertures of leavings of at least the ink, which comes in contact with said nozzle apertures when the blade is pressed on said nozzle plate, contacts the protective layers, and the blade moves in a direction of an open exhaust port disposed on a side of an end of said nozzle plate, such that the leavings are exhausted through the open exhaust port by movement of the blade.

2. An ink-jet recording head according to claim 1, wherein said pressurizing means is one of a piezoelectric vibrator and a heating means provided to said pressure generating chamber.

3. An ink-jet recording head according to claim 1, wherein an ink-repellent layer is formed at least in the vicinity of said nozzle aperture.

4. An ink-jet recording head according to claim 1, wherein said protective layer is 2 to 10 μm thick.

5. An ink-jet recording head according to claim 1, wherein said protective layer is formed by means for forming a film on said nozzle plate.

6. An ink-jet recording head according to claim 1, wherein said protective layer is formed by laminating another member.

7. An ink-jet recording head, comprising:

a plurality of pressure generating chambers arranged at a predetermined pitch in at least one column for pressurizing ink by pressurizing means;

a nozzle plate in which a plurality of nozzle apertures, each of which communicates with a respective one of the pressure generating chambers, are formed, and at least one protective layer formed in predetermined shape in a vicinity of at least one of said nozzle apertures, so that a part of a blade for cleaning the nozzle apertures of leavings of at least the ink, which comes in contact with said nozzle apertures when the blade is pressed on said nozzle plate, contacts the protective layer, and the blade moves in a direction of an open exhaust port disposed on a side of an end of said nozzle plate, such that the leavings are exhausted through the open exhaust port by movement of the blade;

wherein said protective layer is formed discretely approximately in parallel with a path on which the blade is moved and between said nozzle apertures at a pitch longer than a pitch between adjacent nozzle apertures.

8. An ink-jet recording head according to claim 7, wherein each said protective layer is formed so that it is longer than a diameter of one of said nozzle apertures.

9. An ink-jet recording head according to claim 7, wherein each said protective layer is arranged at a pitch at which said protective layer is located at least on one side of the respective one of said nozzle apertures.

10. An ink-jet recording head according to claim 7, wherein a branch perpendicular to said path on which the blade is moved is formed at least at one end of said protective layer.

11. An ink-jet recording head according to claim 10, wherein said branch is formed so that it is at least longer than the pitch between adjacent nozzle apertures.

12. An ink-jet recording head according to claim 10, wherein said branch is formed so that it is wider than a width of said protective layer.

13. An ink-jet recording head according to claim 10, wherein a clearance from which ink can be exhausted is secured between said branch and adjacent another protective layer.

14. An ink-jet recording head according to claim 10, wherein each said branch is alternately arranged with said branch disposed between adjacent said protective layers.

15. An ink-jet recording head according to claim 10, wherein each said branch is formed on a the same side at both ends of said protective layer.

16. An ink-jet recording head according to claim 10, wherein each said branch is formed on opposite sides at both ends of said protective layer.

17. An ink-jet recording head according to claim 7, wherein said protective layer is provided with a linear part approximately perpendicular to said path on which said blade is moved on a side opposite to a direction in which said blade is moved and longer than the pitch between adjacent nozzle apertures, and a curved part on a side opposite to said nozzle aperture.

18. An ink-jet recording head according to claim 17, wherein said protective layer is provided with a vertex tapered from said linear part.

19. An ink-jet recording head according to claim 18, wherein each said protective layer is arranged so that each said vertex is opposite one another.

20. An ink-jet recording head according to claim 19, wherein each said protective layer is arranged at a same pitch as the pitch between adjacent nozzle apertures.

21. An ink-jet recording head according to claim 20, wherein each said protective layer is arranged at a pitch twice as long as pitch between the adjacent nozzle apertures.

22. An ink-jet recording head according to claim 17, wherein said protective layer is formed so that a center is the narrowest.

23. An ink-jet recording head according to claim 22, wherein each said protective layer is symmetrical both in a direction in which said nozzle apertures are arranged and a direction perpendicular to said direction.

24. An ink-jet recording head according to claim 22, wherein each said protective layer is arranged so that said narrowest part is opposite to a respective one of said nozzle apertures.

25. An ink-jet recording head according to claim 18, wherein each said protective layer is symmetrical in a direction perpendicular to a direction in which said nozzle apertures are arranged.

26. An ink-jet recording head according to claim 7, wherein said protective layer surrounds all said nozzle apertures in a same column; and a concave portion provided with an open port at an end on a downstream side in a direction in which said blade is moved, is formed.

27. An ink-jet recording head according to claim 26, wherein a wall for regulating an open port of said concave portion is tilted in a direction in which said blade exhausts.

28. An ink-jet recording head according to claim 26, wherein a boundary between adjacent each said concave portion is connected by a wall tilted in a direction in which said blade exhausts.

29. An ink-jet recording head according to claim 26, wherein said open port is formed outside each of nozzle apertures located at least at an end.

30. An ink-jet recording head according to claim 26, wherein said open port is formed at an end of said nozzle plate.

31. An ink-jet recording apparatus comprising:

an ink-jet recording head comprising:

a blade for cleaning including an elastic member, a plurality of pressure generating chambers arranged at a predetermined pitch in at least one column for pressurizing ink by pressurizing means, and a nozzle plate in which a plurality of nozzle apertures, a respective one of which communicates with each of said pressure generating chambers, are formed, and at least one protective layer formed in a predetermined shape in a vicinity of at least one of said nozzle apertures, so that a part of said blade comes in contact with said respective one of said nozzle apertures when said blade is pressed on said nozzle plate, contacts the protective layer, and the blade moves in a direction of an open exhaust port disposed on a side of an end of said nozzle plate in the protective layer along a nozzle plate surface, and wherein said blade elastically contacts the protective layer and said nozzle plate on a path on which said recording head is moved during cleaning to remove leavings of at least the ink, and the leavings are exhausted through the open exhaust port in the protective layer along the nozzle plate surface, by movement of the blade.

32. An inkjet recording apparatus, comprising:

an ink-jet recording head comprising:

a blade for cleaning including an elastic member, a plurality of pressure generating chambers arranged at a predetermined pitch in at least one column for pressurizing ink by pressurizing means, and a nozzle plate in which a plurality of nozzle apertures, a respective one of which communicates with each of said pressure generating chambers, are formed, and at least one protective layer formed in a predetermined shape in a vicinity of at least one of said nozzle apertures, so that a part of said blade comes in contact with said respective one of said nozzle apertures when said blade is pressed on said nozzle plate, contacts the protective layer, and the blade moves in a direction of an open exhaust port disposed on a side of an end of said nozzle plate, and wherein said blade elastically contacts the protective layer and said nozzle plate on a path on which said recording head is moved during cleaning to remove leavings of at least the ink, and the leavings are exhausted through the open exhaust port by movement of the blade;

wherein said blade is provided with a gradient to a perpendicular to said path on which said blade is moved.

* * * * *